US010683858B1

(12) United States Patent
Madruga

(10) Patent No.: US 10,683,858 B1
(45) Date of Patent: Jun. 16, 2020

(54) HYDRAULIC SYSTEM AND METHOD FOR PROVIDING FLUID PRESSURE TO HYDRAULICALLY-POWERED SYSTEMS

(71) Applicant: Sergio Antonio Madruga, Miami, FL (US)

(72) Inventor: Sergio Antonio Madruga, Miami, FL (US)

( * ) Notice: Subject to any disclaimer, the term of this patent is extended or adjusted under 35 U.S.C. 154(b) by 310 days.

(21) Appl. No.: 15/601,628

(22) Filed: May 22, 2017

Related U.S. Application Data

(60) Provisional application No. 62/341,323, filed on May 25, 2016.

(51) Int. Cl.

| | |
|---|---|
| ***F04B 23/02*** | (2006.01) |
| ***F04B 7/00*** | (2006.01) |
| ***F04B 41/02*** | (2006.01) |
| ***F04B 1/02*** | (2006.01) |
| ***F04B 9/06*** | (2006.01) |
| ***F04B 53/12*** | (2006.01) |
| ***F04B 19/02*** | (2006.01) |

(52) U.S. Cl.
CPC ..... *F04B 23/023* (2013.01); *F04B 1/02* (2013.01); *F04B 7/008* (2013.01); *F04B 9/06* (2013.01); *F04B 19/022* (2013.01); *F04B 41/02* (2013.01); *F04B 53/129* (2013.01)

(58) Field of Classification Search
CPC ..... F04B 23/021–23/028; F04B 41/02; F04B 1/02; F04B 9/06; F04B 53/125; F04B 53/129; F04B 53/12; F04B 7/008; F04B 19/02; F04B 19/022
See application file for complete search history.

(56) References Cited

U.S. PATENT DOCUMENTS

| | | | | |
|---|---|---|---|---|
| 12,601 | A * | 3/1855 | Ling | |
| 2,296,647 | A | 9/1942 | McCormick | |
| 3,952,516 | A | 4/1976 | Lapp | |
| 4,844,700 | A | 7/1989 | Henderson | |
| 4,883,409 | A | 11/1989 | Strohmeier et al. | |
| 6,712,587 | B2 | 3/2004 | Gerhardt et al. | |
| 7,354,252 | B2 | 4/2008 | Baatrup et al. | |
| 7,832,374 | B2 | 11/2010 | Verner et al. | |
| 2008/0099577 | A1 | 5/2008 | Feinleib | |
| 2011/0044828 | A1* | 2/2011 | Lund | F04B 9/06 417/362 |
| 2014/0298787 | A1 | 10/2014 | Selwyn | |

* cited by examiner

*Primary Examiner* — Bryan M Lettman
(74) *Attorney, Agent, or Firm* — John Rizvi; John Rizvi, P.A.—The Patent Professor

(57) ABSTRACT

A hydraulic system is provided for powering one or more external hydraulically powered devices. The system includes one or more pumping systems attached to a common crankshaft and including an inner sleeve, an outer sleeve, a valve member and an end body. The system can include a pair of high pressure fluid tanks and a low pressure fluid tank. The pumping systems can increase the fluid pressure within the high pressure fluid tanks back and forth and in a sequenced manner, and force the higher pressure fluid through the one or more powered devices. Drive systems are provided to assist the pumping systems in rotating the common crankshaft. The drive systems can include a piston assembly for rotating the crankshaft and a valving system for directing fluid into the piston assembly to power the piston assembly.

27 Claims, 13 Drawing Sheets

HYDRAULIC SYSTEM AND METHOD FOR PROVIDING FLUID PRESSURE TO HYDRAULICALLY-POWERED SYSTEMS

CROSS-REFERENCE TO RELATED APPLICATIONS

This application claims the benefit of U.S. Provisional Patent Application Ser. No. 62/341,323, filed on May 25, 2016, which is incorporated herein in its entirety.

FIELD OF THE INVENTION

The present invention relates generally to hydraulic power systems, and more particularly, to a method and apparatus for providing fluid pressure to one or more external hydraulically powered systems.

BACKGROUND OF THE INVENTION

Hydraulic fluid pressure is commonly utilized in industry to generate, control, and transmit power to machines, apparatus or devices for their operation. Devices powered by hydraulic fluid pressure can often produce greater power than conventional electrically-powered devices. Examples of such devices may include impact wrenches, lifting devices, actuators or servos, driving devices for wheels or propellers, turbines, hydraulic motors, etc.

Typically, the high pressure fluid is supplied to these devices from a self-contained source of high pressure fluid or from continuously running permanent pumping stations. Where the source of the high pressure fluid is self-contained, the draw down on the source of fluid pressure eventually reduces the fluid pressure to the point where there is insufficient pressure to operate the device. In the case of permanent pumping stations, these can become inefficient as the fluid power supplied to the device may be lost and the continuing effort to maintain pressure consumes a lot of energy.

Hydraulic accumulators are known in the art for substantially storing hydraulic energy and providing a pressure supply in response to a temporary demand. Accumulators consist in a storage reservoir in which a non-compressible hydraulic fluid is held under pressure, the pressure being provided by an external source such as a weight, spring or bladder accumulator. However, hydraulic accumulators are not intended to provide a long term pressure supply.

Accordingly, there is an established need for a hydraulic power fluid supply system that can supply long term fluid pressure to one or more pressure-fluid-powered devices, preferably in a cost-effective manner.

SUMMARY OF THE INVENTION

The present invention is directed to a hydraulic system and method which can power one or more external hydraulically-powered devices and can recover excess fluid pressure for assistance in operating the system. The hydraulic system can include a pair of high pressure fluid tanks and a common low pressure fluid tank. Alternating pumping systems increase the fluid pressure within the high pressure fluid tanks and force the higher pressure fluid through the one or more external hydraulically-powered devices. Drive systems can be provided to assist the pumping systems in providing hydraulic fluid pressure to the powered devices along with rotating a common crankshaft. The drive systems can include a piston assembly for rotating the crankshaft and a valving system for directing fluid into the piston assembly to power the piston assembly.

In a first implementation of the invention, a hydraulic system for hydraulically powering one or more external devices includes at least one pump assembly, wherein each pump assembly is formed along a longitudinal direction extending from a proximal end to a distal end of the pump assembly. Each pump assembly comprises an outer sleeve, an inner sleeve, a valve member and an end body. The outer sleeve has at least one window formed through a sidewall of the outer sleeve. The inner sleeve is longitudinally movable inside the outer sleeve and includes a first inner cavity and a second inner cavity arranged within the inner sleeve. The second inner cavity is longitudinally spaced apart and positioned distally from the first inner cavity. The inner sleeve further includes at least one window formed through a sidewall of the inner sleeve and facing the second inner cavity. The valve member, in turn, is longitudinally movable inside the inner sleeve and is configured to reversibly move between a closed position, blocking fluid flow between the first and second inner cavities of the inner sleeve, and an open position, allowing fluid flow between the first and second inner cavities of the inner sleeve. The end body is positioned distally from the valve member and is longitudinally movable within the second inner cavity of the inner sleeve. The pump assembly can adopt a driving configuration in which the valve member is in the closed position and the end body pushes the inner sleeve towards the proximal end of the pump assembly.

In a second aspect, the hydraulic system can further include a high pressure fluid tank. When the pump assembly is in the driving configuration, the end body can be arranged within the high pressure fluid tank and can be pushed toward the inner sleeve by pressure from fluid contained within the high pressure fluid tank.

In another aspect, the outer sleeve can be non-movable relative to the high pressure fluid tank.

In another aspect, the high pressure fluid tank can be in fluid communication with a hydraulically-powered system for feeding fluid from the high pressure fluid tank to the hydraulically-powered system to power the hydraulically-powered system.

In another aspect, the pump assembly can further adopt a pumping configuration in which the inner sleeve and end body move distally relative to the outer sleeve and the end body provides a pushing end of the pump assembly for pushing a fluid.

In another aspect, the pump assembly can further adopt a fluid-intaking configuration in which the end body is stopped from moving longitudinally and proximally by the outer sleeve and the inner sleeve is moving proximally relative to the end body. In this fluid-intaking configuration, an enclosed internal space is being formed between the inner sleeve and the end body and a depression is being formed within the internal space. The depression is moving the valve member to the open position allowing the passage of a specific amount of fluid from the first inner cavity of the inner sleeve to the internal space.

In another aspect, the hydraulic system can further include a low pressure fluid tank. A proximal end of the inner sleeve can be arranged within the low pressure fluid tank. When the pump assembly is in the fluid-intaking configuration, the first inner cavity can be in fluid communication with the low pressure fluid tank for absorbing fluid therefrom.

In another aspect, the outer sleeve can be non-movable relative to the low pressure fluid tank.

In another aspect, the pump assembly can further adopt a fluid-transporting configuration in which the valve member is in the closed position and the inner sleeve, valve member, end body and specific amount of fluid move jointly and distally relative to the outer sleeve and carry the specific amount of fluid towards the at least one window formed on the sidewall of the outer sleeve.

In another aspect, the pump assembly can further adopt a fluid-expelling configuration in which the internal space and the at least one window formed on the sidewall of the inner sleeve are at least partially aligned with the at least one window formed on the sidewall of the outer sleeve. In this fluid-expelling configuration, the end body is moving proximally relative to the inner sleeve and pushing the specific amount of fluid from the internal space to flow outward of the pump assembly through the windows formed on the sidewall of the inner sleeve and the sidewall of the outer sleeve.

In another aspect, a proximal end of the end body can include a recess facing at least one closure valve. The closure valve(s) can be configured to selectively allow or prevent fluid flow from the internal space towards the first inner cavity of the inner sleeve. When the pump assembly is in the driving configuration, the at least one closure valve is open allowing fluid to flow from the internal space towards the first inner cavity.

In another aspect, the hydraulic system can further include a crankshaft arranged proximally from the at least one pump assembly. Each pump assembly can be pivotably and eccentrically attached to the crankshaft. When the pump assembly is in the driving configuration, the pump assembly can drive the crankshaft to rotate.

In another aspect, the pump assembly can further include an articulation shaft pivotably attached to the inner sleeve and pivotably and eccentrically attached to the crankshaft.

In another aspect, the hydraulic system can include two pump assemblies and further include two high pressure fluid tanks. The two pump assemblies can be attached to opposite sides of the crankshaft and operate in a 180-degree offset configuration. The end body of each pump assembly can be arranged within a respective one of the two high pressure fluid tanks, and the end bodies of the pump assemblies can be alternately pushed toward the corresponding inner sleeve by pressure from fluid contained within the respective high pressure fluid tank.

In another aspect, the hydraulic system can further include at least one piston assembly. Each piston assembly can be associated to a respective pump assembly and can be pivotably connected to the crankshaft and configured to expand and compress a chamber of the piston assembly in synchronization with rotation of the crankshaft. The chamber of each piston assembly is in fluid communication with a valving system.

In another aspect, the valving system can be configured to selectively establish fluid communication from the chamber of the piston assembly towards a low pressure fluid tank external to the piston assembly when the piston is assembly is compressing.

In another aspect, the valving system can be configured to selectively establish fluid communication from a low pressure fluid tank external to the piston assembly to the chamber of the piston assembly when the piston assembly is expanding by the crankshaft rotating responsively to the pump assembly being in the driving configuration and driving the crankshaft.

In another aspect, the valving system can be configured to selectively establish fluid communication from a high pressure fluid tank external to the piston assembly to the chamber of the piston assembly to force the piston assembly to expand and drive the crankshaft.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a novel hydraulic system and method of increasing fluid pressure in a hydraulic system for use in powering one or more external hydraulically-powered devices or systems. Examples of such hydraulically-powered devices or systems may include impact wrenches, lifting devices, actuators or servos, driving devices for wheels or propellers, turbines, hydraulic motors, oil extraction systems, gas or fluid fuel transportation systems, etc.

Figure 1:
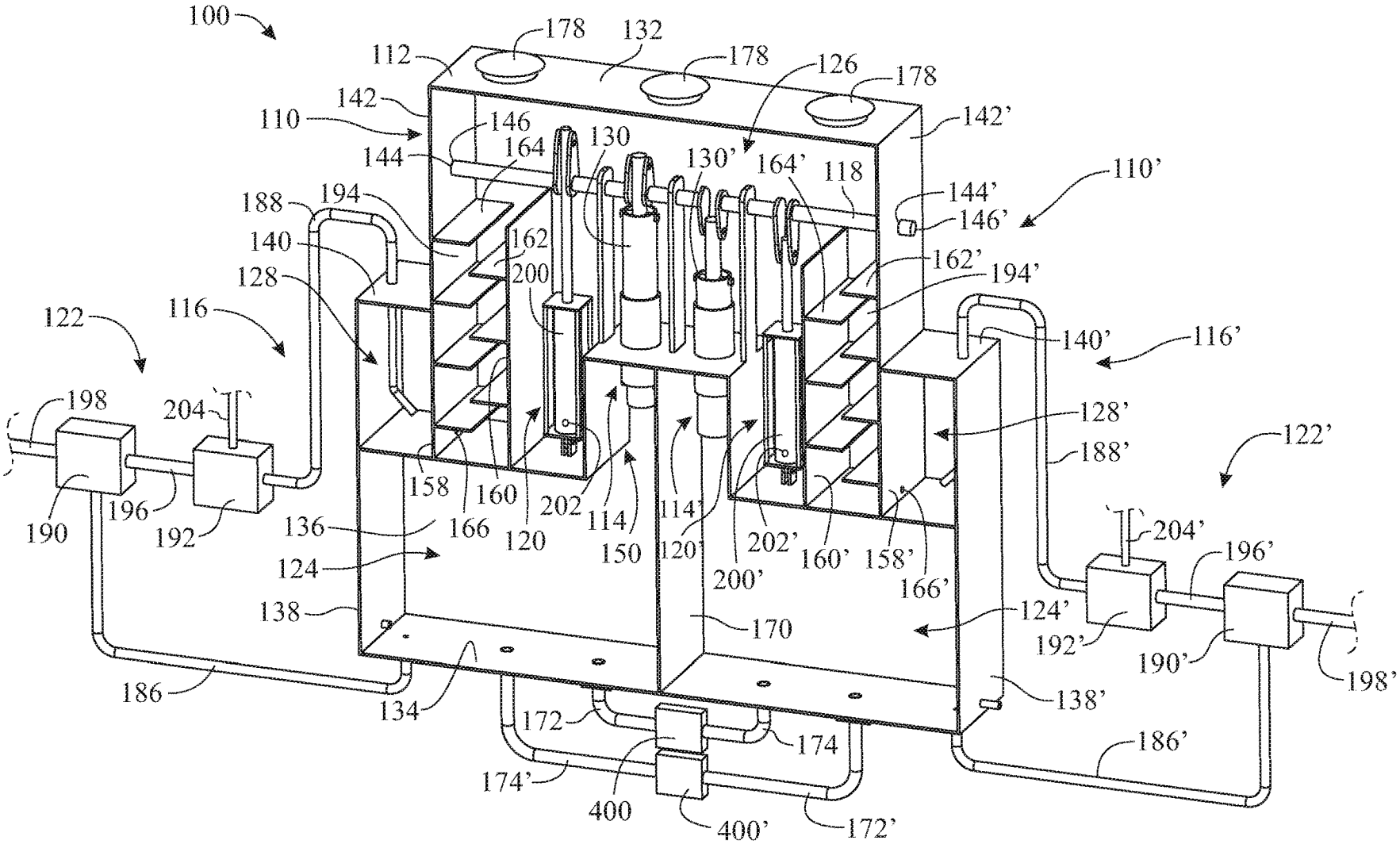
FIG. 1 presents a top front perspective view of an exemplary embodiment of a hydraulic system for use in powering two hydraulically-powered devices, the hydraulic system including a pair of mirror image hydraulic driving and pumping systems.
Figure 2:
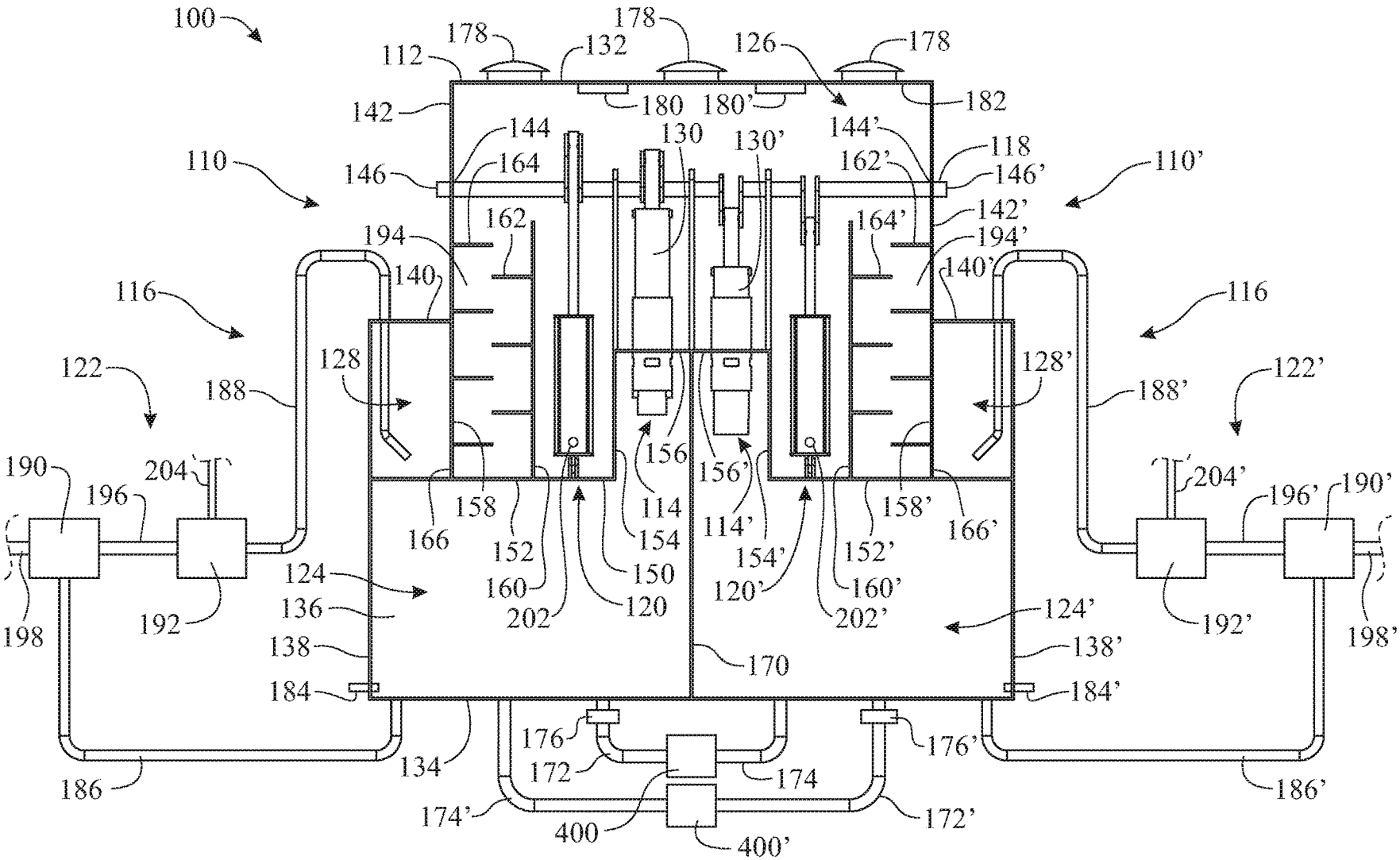
FIG. 2 presents a front elevation view of the hydraulic system of FIG. 1.

Referring initially to FIGS. 1 and 2, a hydraulic system 100 is illustrated in accordance with an exemplary embodiment of the present invention, configured as a series of hydraulic sub-systems 110, 110', etc. (two hydraulic sub-systems 110, 110' being shown in the drawings). The hydraulic sub-systems 110, 110' are partially housed in a common housing 112 and are operable so as to provide hydraulic fluid pressure in order to drive one or more hydraulically-powered external devices (e.g., two hydraulically-powered devices 400, 400') as described in more detail hereinbelow.

As shown, each of the hydraulic sub-systems 110, 110' can include a fluid pumping system 114, 114' driven by a piston operated drive system 116, 116'. The piston operated drive systems 116, 116' can be articulately connected to a common crankshaft 118. The hydraulic sub-systems 110 and 110' of the present embodiment are mirror images of each other and are constructed identical to each other. The hydraulic sub-systems 110 and 110' are designed and controlled to operate 180° out of phase from each other. Each of the drive systems 116, 116' generally includes a piston assembly 120, 120' for alternately rotating the common crankshaft 118 and a valving assembly 122, 122' for operating the piston assemblies 120, 120' with hydraulic fluid siphoned off from the hydraulic system 100 as a whole.

The housing 112, which is shown in FIG. 1 devoid of a front wall or closure in order to reveal its internal components for illustrative purposes, contains the fluid pumping systems 114, 114' and the piston assemblies 120, 120'. The housing 112 includes a first high pressure fluid tank 124 associated with hydraulic sub-system 110, a second high pressure fluid tank 124' associated with hydraulic sub-system 110', and a common low pressure fluid tank 126 associated with both hydraulic sub-systems 110, 110'. For instance and without limitation, the high pressure fluid tanks 124, 124' can contain fluid at a pressure of 6000 psi (pounds per square inch) or $41.37\times10^6$ N/m$^2$, and the common low pressure fluid tank 126 can contain fluid at a pressure of 14.7 psi ($101.33\times10^3$ N/m$^2$ or 1 atmosphere). The housing 112 further includes auxiliary tanks 128, 128' which are provided to recover fluid passing through the respective valving assemblies 122, 122' and return the fluid to the common low pressure fluid tank 126.

The fluid pumping systems 114 are provided to increase the fluid pressure within each of the respective high pressure fluid tanks 124, 124'. The fluid pumping systems 114, 114' each include pump assemblies 130, 130' which are connected to the common crankshaft 118, and can alternately operate and be operated by the common crankshaft 118, as will be explained in greater detail hereinafter. The pump assemblies 130, 130' are driven down into the high pressure fluid tanks 124, 124' by the common crankshaft 118, reducing the effective volume the hydraulic fluid occupies within the respective high pressure fluid tanks 124, 124' and thus increasing the fluid pressure within the high pressure fluid tanks 124, 124' and providing higher pressure fluid to operate the associated external hydraulically powered devices 400, 400'. Furthermore, as will be described in greater detail hereinafter, pump assemblies 130, 130' also capture an amount of hydraulic fluid from the common low pressure tank 126 and inject the captured fluid at high pressure into the high pressure fluid tank 124, 124', further contributing to increase the fluid pressure in the high pressure fluid tanks 124, 124'.

The housing 112 generally defines the high pressure fluid tanks 124, 124', the common low pressure fluid tank 126 and the auxiliary tanks 128, 128'. In an exemplary and non-limiting construction shown in FIGS. 1 and 2, the housing 112 includes a top wall 132, a bottom wall 134 and a back wall 136. As mentioned heretofore, the housing 112 additionally includes a front wall (not shown) which has been removed for clarity. The housing 112 further includes first side wall sections 138, 138', second side wall sections 140, 140' and third side wall sections 142, 142'. The third wall sections 142 and 142' include respective holes 144, 144' for receipt and rotational support of opposed ends 146 and 148 of the common crankshaft 118. Vent caps 178 are provided in the top wall 132 to vent excess pressure from the common low pressure fluid tank 126.

The housing 112 further includes an internal partition 150 separating the high pressure fluid tanks 124, 124' from the common low pressure fluid tank 126. The internal partition 150 can include, for instance and without limitation, first horizontal sections 152, 152', vertical sections 154, 154' and second horizontal sections 156, 156'. Wall extensions 158, 158' along with portions of the first side wall sections 138, 138', the second side wall sections 140, 140' and first horizontal sections 152, 152,' of the internal partition 150, define the auxiliary tanks 128, 128'.

In order to slow the transfer of fluids from the auxiliary tanks 128, 128' to the common low pressure fluid tank 126, the housing 112 further includes vertically extending internal walls 160, 160', which can extend from the back wall 136 to the front wall (not shown) of the housing 112, thus enclosing the auxiliary tanks 128, 128'. Baffle plates 162, 162' extend horizontally from the internal walls 160, 160' and baffle plates 164, 164' extend inwardly from third side wall sections 142, 142' and wall extensions 158, 158' in staggered fashion as shown. The area between the baffle plates 162, 162' and 164, 164' forms a dissipation chamber 194, 194' for reducing the pressure of high pressure fluid passing through the dissipation chamber 194, 194' on its way to the low pressure fluid tank 126, will be described in greater detail hereinafter.

As best shown in FIG. 1, a respective orifice 166, 166' is provided in the wall extensions 158, 158' between the auxiliary tanks 128, 128' and the common low pressure fluid tank 126, to allow fluid to pass from the auxiliary tanks 128, 128' to the low pressure fluid tank 126. A divider 170 separates the high pressure fluid tanks 124 and 124'. In some embodiments, a safety valve (not shown) may be provided on each orifice 166, 166' to allow a faster transfer of fluid from each auxiliary tank 128, 128' to the low pressure fluid tank 126 in the event of an excessively high fluid pressure within the auxiliary tank 128, 128'.

As noted above, the hydraulic sub-systems 110, 110' operate 180° out of phase with each other to alternately pump fluid from the high pressure fluid tanks 124, 124' and through the external hydraulically powered devices 400, 400' to power the devices. The hydraulic sub-systems 110, 110' include inlet tubes 172, 172' through which high pressure fluid flows from the high pressure fluid tanks 124, 124' into the powered devices 400, 400' and outlet tubes 174, 174' through which the fluid flows into the opposing high pressure fluid tanks 124', 124. One-way valves 176, 176' are provided in the inlet tubes 172, 172' to prevent backflow of fluid back into the respective high pressure fluid tanks 124, 124'.

As best shown in FIG. 2, in order to control the flow of hydraulic fluid into and through the system, the hydraulic system 100 is provided with sensors 180, 180' located for instance on an underside 182 of the top wall 132 of the housing 112. The sensors 180, 180' are located within the common low pressure fluid tank 126 and positioned above the respective piston assemblies 120, 120' of the drive systems 116, 116'. The sensors 180, 180' are provided to detect the status or position of the piston assemblies 120, 120' of the drive systems 116, 116' and control valves associated with the drive systems 116, 116' as described in more detail hereinbelow.

High pressure hydraulic fluid can be supplied to the high pressure fluid tanks 124, 124' through accumulator valves 184, 184'. The accumulator valves 184, 184' are in fluid communication with external fluid accumulators (not shown) and are controlled by the sensors 180, 180' to feed high pressure fluid into the high pressure fluid tanks 124, 124'. The accumulator valves 184, 184' are controlled by the sensors 180, 180' and are opened and closed depending on the detected condition of the piston assemblies 120, 120'.

Figure 3:
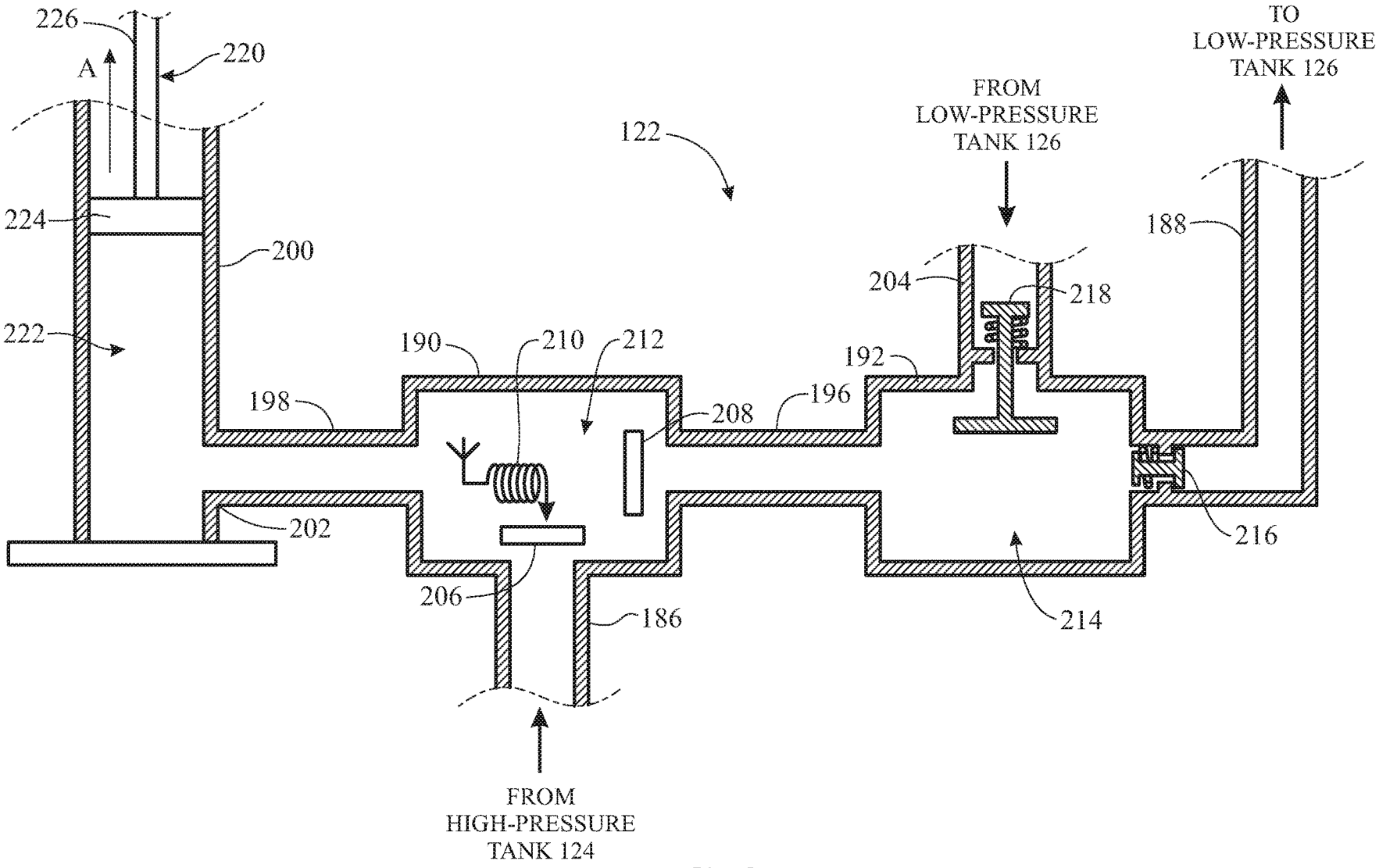
FIG. 3 presents a schematic diagram of a valve system associated with one of the hydraulic drive systems.

Turning now to FIGS. 1-3, the piston assemblies 120, 120' and the valving assemblies 122, 122' of the drive systems 116, 116' will now be described.

Figure 4:
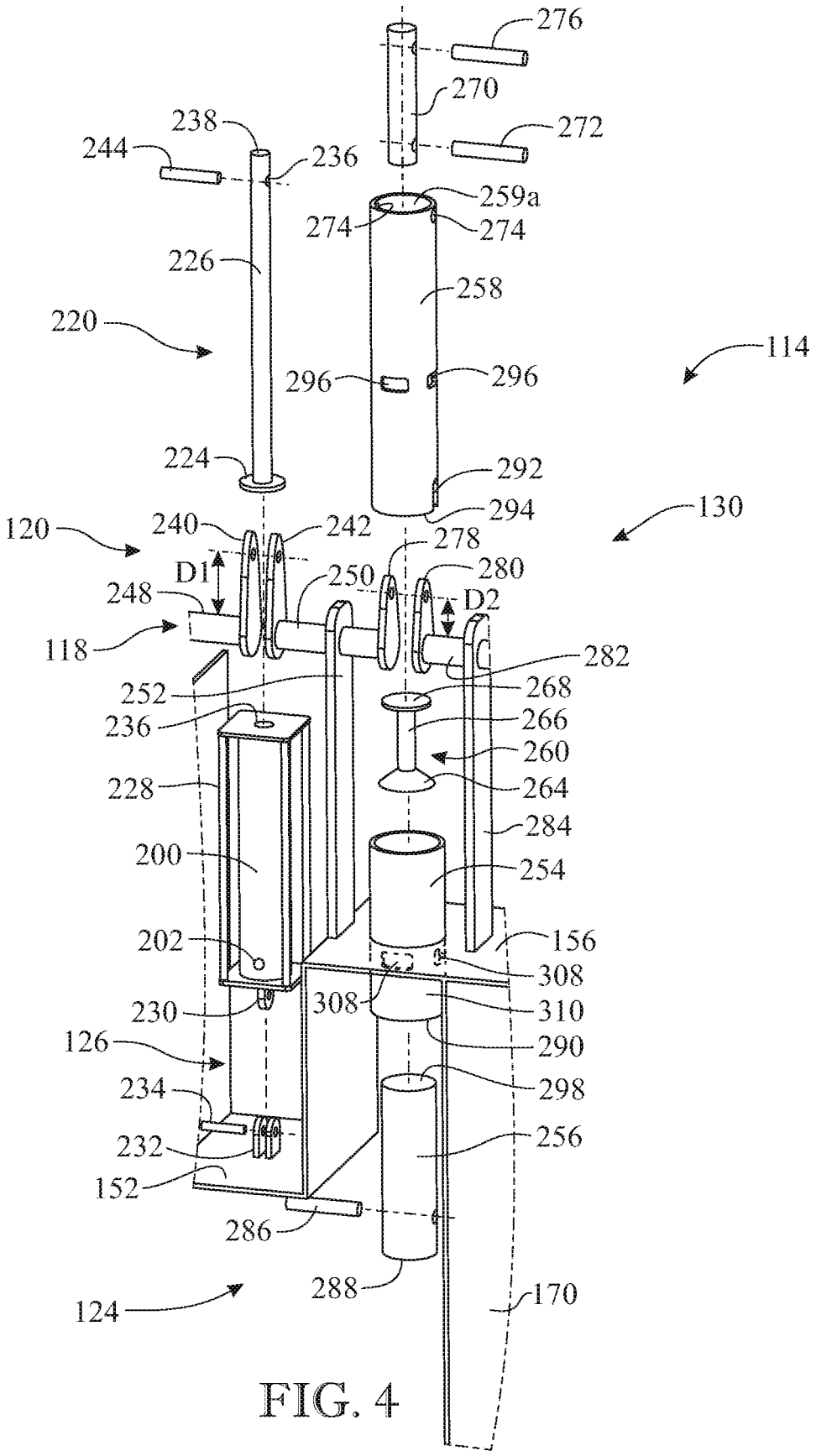
FIG. 4 presents an exploded, top front perspective view of the piston and cylinder components of one of the hydraulic driving and pumping systems.

The piston assemblies 120, 120' generally include a piston sleeve 200, 200'. A connector 202, 202' is provided at the bottom of the piston sleeve 200, 200' for receipt and connection to a flexible drive tube 198, 198'. A plunger 220, 220' is movably arranged within the piston sleeve 200, 200'. The plunger 220, 220' includes a piston head 224, 224' carried by a drive or piston rod 226, 226'. The piston head 224, 224' sealingly and slidably contacts the piston sleeve 200, 200' and delimits a lower chamber 222, 222' within the piston sleeve 200, 200'. In turn, the piston rod 226 extends upward from the piston head 224 and is connected to the common crankshaft 118 (FIG. 4). The connector 202, 202' provides fluid access to the lower chamber 222, 222'.

The valving assemblies 122, 122' generally include a supply tube 186, 186' in fluid communication with the corresponding high pressure fluid tank 124, 124' and a return tube 188, 188' in fluid communication with the corresponding auxiliary tank 128, 128'. The valving assemblies 122, 122' include a first drive valve 190, 190' and a second drive valve 192, 192'. A connection tube 196, 196' extends between the first drive valve 190, 190' and the corresponding second drive valve 192, 192'. The flexible drive tube 198, 198' extends from the first drive valve 190, 190' to the piston sleeve 200, 200' of the piston assemblies 120, 120'. The full length of the drive tube 198, 198' has been omitted from FIGS. 1 and 2 for clarity. Second return tubes 204, 204' extend between the second drive valves 192, 192' and the low pressure fluid tank 126 for receiving fluid from the low pressure fluid tank 126. The full length of the second return tubes 204, 204' has also been omitted from FIGS. 1 and 2 for clarity.

The following description of the details of the drive systems 116, 116', including the piston assemblies 120, 120' and the valving assemblies 122, 122', will be given with regard to the drive system 116 but is equally applicable to the components of the mirror image drive system 116'. With specific reference to FIG. 3, the first drive valve 190 includes a first shutter 206 which opens and closes to allow in high pressure fluid from high pressure tank 124 via the supply tube 186 and a second shutter 208 which opens and closes to transfer fluid from the first drive valve 190 to the second drive valve 192 through the connection tube 196. The first drive valve 190 further includes a receiver 210 that controls the positions of the first and second shutters 206 and 208 in response to commands received from the sensor 180. In a first condition, the second shutter 208 is closed blocking off the connection tube 196 and the first shutter 206 is opened to allow high pressure fluid to flow from the high pressure tank 124 via the supply tube 186, through a cavity 212 of the first drive valve 190 and into the drive tube 198 to power the piston assembly 120 as described in more detail hereinbelow. In a second position, the first shutter 206 is closed, cutting off fluid communication between the high pressure tank 124 and the first drive valve 190, and the second shutter 208 is open, providing fluid communication between the second drive valve 192 and the first drive valve 190.

The second drive valve 192, in turn, includes a first one-way valve 216 in fluid communication with the return tube 188 and a second one-way valve 218 in fluid communication with the second return tube 204. The first and second one-way valves 216 and 218 are normally closed, for which each valve 216, 218 includes a respective compression spring (not numbered) configured to bias the valve to a closed position. When the second shutter 208 of the first drive valve 190 is closed, the first and second one-way valves 216 and 218 are closed. When the second shutter 208 of the first drive valve 190 is open, movement of the piston head 224 determines which of the first and second one-way valve 216 and 218 will open. Specifically, when the piston head 224 is moving downward, pushing fluid from the lower chamber 222 into the drive tube 198 and through the cavity 212 of the first drive valve 190 into the cavity 214 of the second drive valve 192, said pushed fluid will open the first one-way valve 216 while the second one-way valve 218 remains closed. If the piston head 224 is instead moving upward, suctioning fluid from the cavities 212, 214 towards the lower chamber 222 of the plunger 200, said fluid suction will open the second one-way valve 218 while the first one-way valve 216 remains closed.

Referring now to FIG. 4, the piston sleeve 200 of the piston assembly 120 is supported within the low pressure fluid tank 126 on a piston support bracket 228. The piston support bracket 228 is movably mounted to the first horizontal section 152 of the housing 112 by a pair of piston articulation brackets 230 and 232 and a pin 234. The piston articulation brackets 230 and 232 allow the piston support bracket 228 and the piston sleeve 200 to rock or articulate about the pin 234 as the piston rod 226 moves with the common crankshaft 118. The piston rod 226 extends into the piston sleeve 200 through a top hole 236. A top end 238 of the piston rod 226 is connected to the common crankshaft 118 by a pair of first crankshaft brackets 240 and 242 and rotatably secured thereto by a pin 244 extending through the brackets 240, 242 and through a hole 236 in the piston rod 226. The first crankshaft brackets 240, 242 are fixedly mounted to the common crankshaft 118. Specifically, first crankshaft bracket 240 is affixed to a first crankshaft section 248 and first crankshaft bracket 242 is affixed to a second crankshaft section 250, which is supported by a first support member 252 that extends upwardly from the second horizontal section 156 of the housing 112. The brackets 240, 242 define a rotation axis of the pin 244; the rotation axis is arranged eccentrically from the common crankshaft 118, and more specifically at a distance D1 from the rotation axis of the common crankshaft 118, the distance D1 defining the moment arm of the piston assembly 120 on the crankshaft 118. As noted above and best shown in FIG. 2, the end 146 of the common crankshaft 118 and specifically the first crankshaft section 248 is rotatably mounted through, and supported in, the hole 144 in the third side wall section 142 of the housing 112. While the rotation axes of the present embodiment (defined by pins 234, 244) are arranged at opposite, top and bottom ends of the piston assembly 120, alternative embodiments are contemplated in which they may be arranged at different lengths of the piston assembly 120 (for instance, the piston assembly 120 may have a fixed bottom end and upper rotation axes as will be explained hereinafter with reference to pins 272, 276, which provide a pair of rotation axes for the pump assembly 130).

Continued reference to FIG. 4 also provides a further understanding of the fluid pumping system 114. As noted above, the fluid pumping system 114 includes the pump assembly 130 mounted within the housing 112. The pump assembly 130 generally includes a fixed cylindrical sleeve 254 non-movably formed (or mounted) through the second horizontal section 156 of the housing 112. The pump assembly 130 further includes an end body, which in the present embodiment is formed as a solid cylinder 256, and a movable inner sleeve 258, both of which are slidably positioned within the fixed cylindrical sleeve 254. The movable inner sleeve 258 is connected to the common crankshaft 118. Further, the pump assembly 130 includes a valve member 260.

Figure 5:
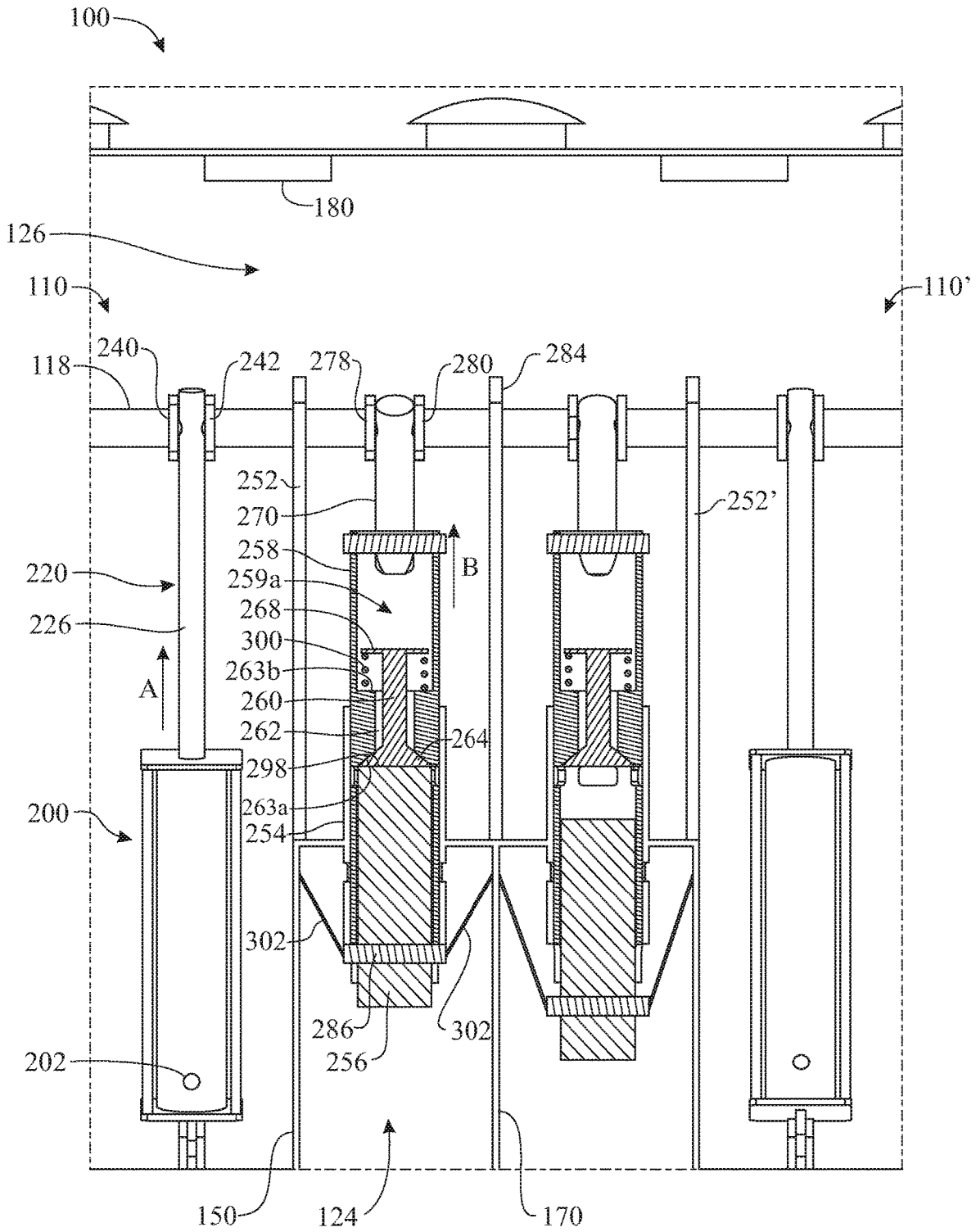
FIG. 5 presents an enlarged front elevation view, partially shown in cross-section, of the driving and pumping systems in a first position of a cycle of operation, with a first plunger of a first drive system in an intermediate rising position rotating a common crankshaft.
Figure 6:
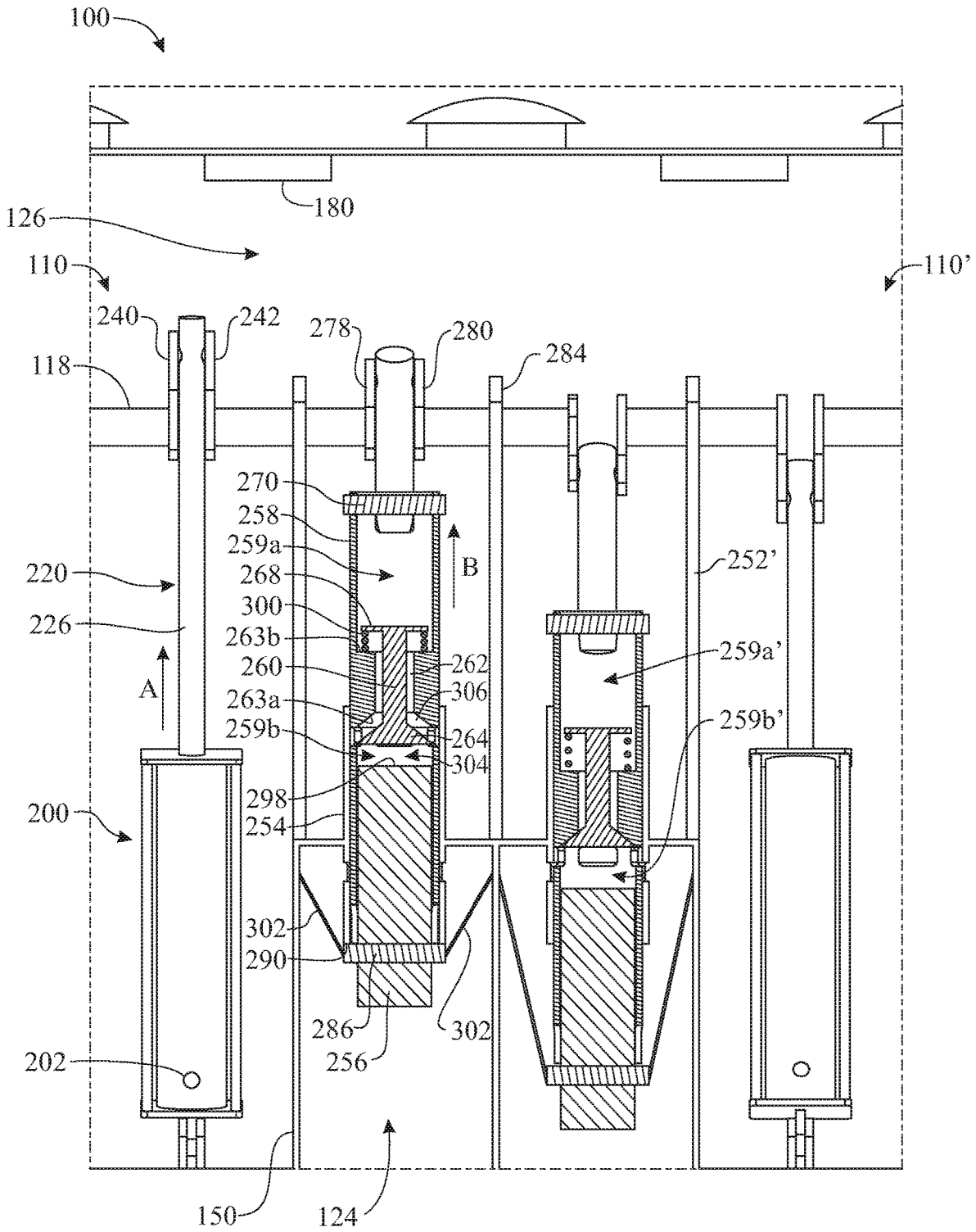
FIG. 6 presents an enlarged front elevation view, partially shown in cross-section, of the driving and pumping systems in a second position of a cycle of operation, with a pump assembly of the pumping system receiving a small amount of low pressure fluid.

The movable inner sleeve 258, as best shown in FIGS. 5 and 6, is a generally cylindrical part comprising a generally cylindrical first inner cavity 259*a*, a generally cylindrical second inner cavity 259*b* and a generally cylindrical intermediate channel 262 which is narrower (has a smaller diameter) than the first and second inner cavities 259*a* and 259*b*. At a top end, the first inner cavity 259*a* is open and in fluid communication with the common low pressure fluid tank 126, and is thus filled with low pressure fluid. The intermediate channel 262 communicates at a first end thereof with the first inner cavity 259*a* and is surrounded by an annular, top transverse surface 263*b*. A bottom tapered opening 263*a* extends from an opposite, second end of the intermediate channel 262 and communicates with the second inner cavity 259*b*.

The valve member 260 is movably mounted within the movable inner sleeve 258 and above the solid cylinder 256. Specifically, the valve member 260 is movably constrained within the intermediate channel 262 (FIG. 5) in the movable inner sleeve 258. The valve member 260 includes a lower valve head 264, a central shaft 266 and an upper valve plate 268. The lower valve head 264 is configured to sealingly rest upon a mating surface of the movable inner sleeve 258 and sealingly close the bottom tapered opening 263*a* (FIG. 5) of the movable inner sleeve 258 which communicates with the intermediate channel 262. The central shaft 266, in turn, is configured to axially move along the intermediate channel 262 while leaving a gap within the intermediate channel 262 for the passage of fluid therethrough. Finally, the valve head 264 is wider than the intermediate channel 262 and configured to rest upon the top transverse surface 263*b* (FIG. 5) of the movable inner sleeve 258, in order to seal or close the intermediate channel 262.

Since the movable inner sleeve 258 moves up and down within the fixed cylindrical sleeve 254 it does not articulate with the rotation of the common crankshaft 118. Instead, an articulation shaft 270 is provided to connect the vertically moving movable inner sleeve 258 to the rotating common crankshaft 118 in order to prevent any sideways force or torque on the movable inner sleeve 258. The articulation shaft 270 is connected to the movable inner sleeve 258 by a pin 272 extending through diametrically-opposed holes 274 in the movable inner sleeve 258 at a top end thereof. An opposite end of the articulation shaft 270 is connected to the common crankshaft 118 by a pin 276 which extends through a pair of second crankshaft brackets 278, 280 fixedly mounted to the common crankshaft. Specifically, second crankshaft bracket 278 is affixed to the second crankshaft section 250 while second crankshaft bracket 280 is affixed to a third or central crankshaft section 282. The second crankshaft brackets 278, 280 define a rotation axis of the pin 276; the rotation axis is arranged eccentrically from the common crankshaft 118, and more specifically at a distance D2 from the rotation axis of the common crankshaft 118. A central support member 284 extends upward from the second horizontal section 156 and rotatably supports the central crankshaft section 282.

With continued reference to FIG. 4, a pin 286 extends through a bottom end 288 of the solid cylinder 256 and can engage a bottom edge 290 of the fixed cylindrical sleeve 254 to limit the upward movement within the fixed cylindrical sleeve 254. Diametrically-opposed, axially-oriented slots 292 are formed on a bottom edge 294 of the movable inner sleeve 258 to receive the pin 286 of the solid cylinder 256; the slots 292 are sized to allow the pin 286 to move axially therealong. Finally, one or more openings or windows 296 (for instance, four windows 296) are formed through the movable inner sleeve 258 to allow low pressure fluid to pass through into the movable inner sleeve 258 for purposes that will be described in more detail hereinbelow.

Referring now to FIGS. 1-12, and initially with regard to FIGS. 2, 3 and 5, the operation of the hydraulic system 100 will now be described, focusing on the operation of the hydraulic sub-system 110 to power the external hydraulically powered device 400. The operation of the mirror image hydraulic sub-system 110' to power the external hydraulically powered device 400' is identical except for operation 180° out of phase from that described. Reference will be made to this mirror image half of the system, designated by the apostrophed (') corresponding components, where appropriate for further understanding of the transfer of fluid pressures within the system 100.

Figure 12:
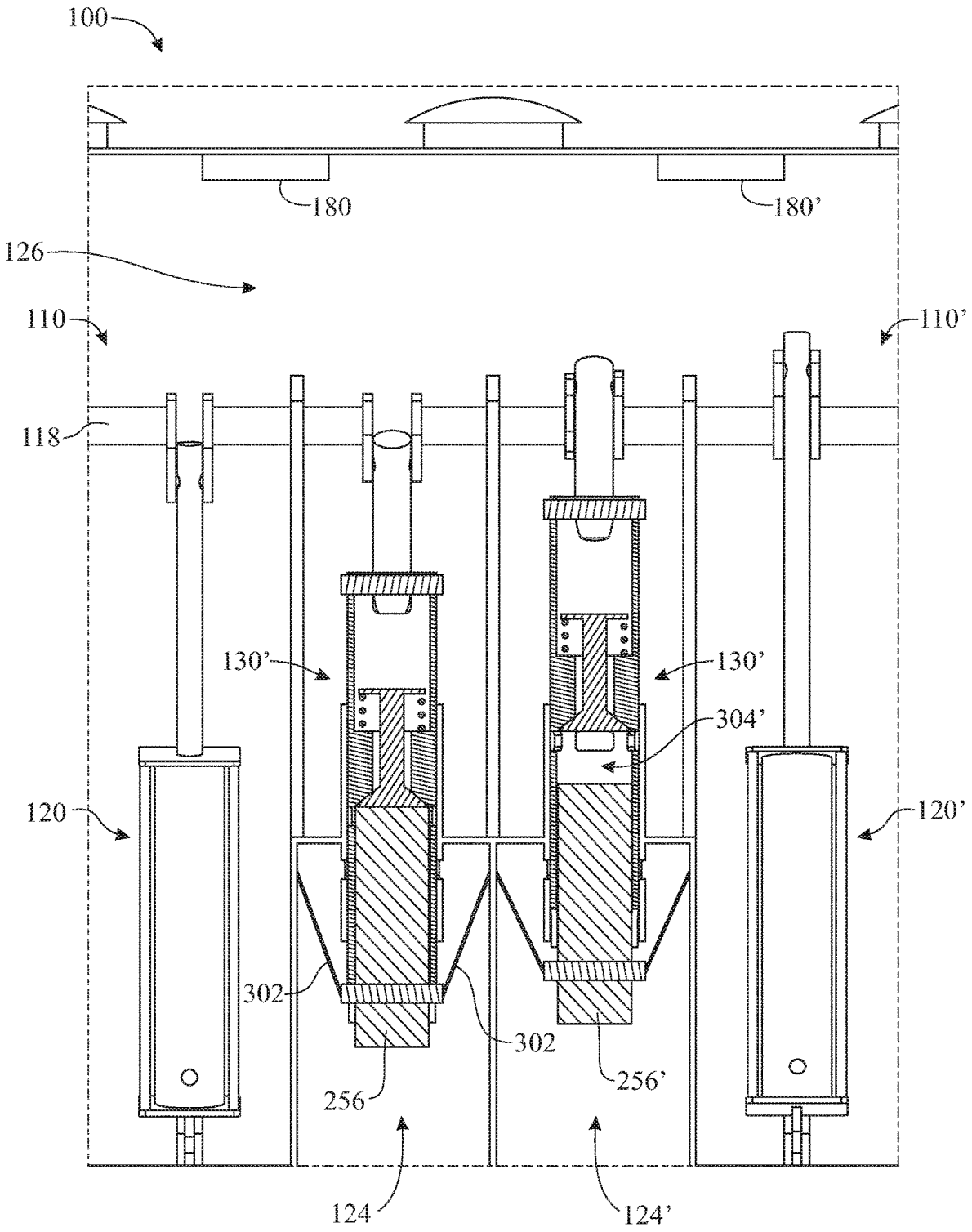
FIG. 12 presents an enlarged front elevation view, partially shown in cross-section, of the driving and pumping systems in an eighth position of a cycle of operation, with the driving and pumping systems being moved upward to recover the condition of FIG. 5.

Referring initially to FIG. 5, the illustration shows the system 100 in an operating condition which comes after the operating condition of FIG. 12. In FIG. 5, the sensor 180 has detected the specific position of the piston assembly 120, specifically a position in which the plunger 220 is in a substantially midway position within the piston sleeve 200 and moving upward. Responsively, the sensor 180 has sent a signal to the receiver 210 in the first drive valve 190 (FIG. 3), causing the first drive valve 190 to responsively open the first shutter 206 and close the second shutter 208. Opening of the first shutter 206 has caused high pressure from the high pressure fluid tank 124 to penetrate the lower chamber 222 of the piston sleeve 200 via the supply tube 186, the cavity 212 of the first drive valve 190 and the connector 202 of the piston sleeve 200, while the closed second shutter 208 blocks fluid communication between the first drive valve 190 and the second drive valve 192. Thus, the lower chamber 222 of the piston sleeve 200 is filling with high pressure fluid through the first drive valve 190 and supply tube 186, and the high pressure fluid is pushing the piston head 224 upward (FIG. 3). In consequence, as shown in FIG. 5, the piston rod 226 is moving upward in the direction of arrow "A" and exerting a force on the first crankshaft brackets 240, 242 to rotate the common crankshaft 118. Because the distance D1 (FIG. 4) provided by the first crankshaft brackets 240, 242 connected to the piston assembly 120 is significantly longer than the distance D2 (FIG. 4) provided by the second crankshaft brackets 278, 280 connected to the movable inner sleeve 258 of the pump assembly 130, the first crankshaft brackets 240, 242 have a greater moment arm, allowing the higher pressure fluid moving into the piston assembly 120 to create a large torque on the common crankshaft 118 which drives the common crankshaft 118 to rotate. In other words, the high pressure fluid within the high pressure tank 124 is being used to drive the crankshaft 118.

Regarding the internal components of the fluid pumping system 114, as best shown in FIG. 5, the valve member 260 is in a topmost position within the movable inner sleeve 258 such that the lower valve head 264 is sealingly closing the bottom tapered opening 263*a* and the intermediate channel 262. A biasing, compression spring 300 is provided around the central shaft 266, and engages the upper valve plate 268 of the valve member 260 and the top transverse surface 263*b* of the movable inner sleeve 258 to counteract the resulting, downward force exerted by the fluid in the low pressure fluid tank 126 on the upper valve plate 268 and maintain the valve member 260 in the sealed condition. A bottom side of the lower valve head 264, in turn, is resting against the upper surface 298 of the solid cylinder 256. As shown, extension springs 302 are provided to bias the solid cylinder 256 upward within the fixed cylindrical sleeve 254, one extension spring 302 is connected to the internal partition 150 and to one end of the pin 286, while the other extension spring 302 is connected to the divider 170 and to the opposite end of the pin 286.

As noted, in the situation of FIG. 5, the plunger 220 drives the common crankshaft 118 to rotate by pushing the first crankshaft brackets 240, 242. Rotation of the common crankshaft 118 causes the rotation of the second crankshaft brackets 278, 280, which in turn causes the upward pulling of the articulation shaft 270 and the upward axial movement of the movable inner sleeve 258 within the fixed cylindrical sleeve 254 (as illustrated by arrow "B").

Referring to FIG. 6, as the movable inner sleeve 258 rises in the direction of arrow "B" within the fixed cylindrical sleeve 254, the solid cylinder 256 is prevented from moving in the direction of arrow "B" by the pin 286 contacting against the bottom edge 290 of the fixed cylindrical sleeve 254. Thus, the upper surface 298 of the solid cylinder 256 and the lower valve head 264 of the valve member 260 begin to separate, an internal space 304 thereby being formed therebetween. As the movable inner sleeve 258 continues to move upward, the internal space 304 increases. Because the lower valve head 264 was initially (FIG. 5) closing the bottom tapered opening 263*a*, the internal space 304 is initially isolated; thus, the internal space 304 increasing its size causes a depression to form in the internal space 304. The depression within the internal space 304 creates a vacuum between the lower valve head 264 and the solid cylinder 256 within the internal space 304. This vacuum pulls down slightly on the lower valve head 264 to create a gap 306 between the lower valve head 264 and the surrounding tapered walls defining the bottom tapered opening 263*a*. As a result of the gap 306 being formed, the vacuum within the internal space 304 draws low pressure fluid from the common low pressure fluid tank 126 into the internal space 304 through the open moveable inner sleeve 258, and particularly through the inner cavity 259, the intermediate channel 262 and the gap 306. This temporary open situation of the valve member 260 is shown in FIG. 6. The biasing spring 300 of the valve member 260 is now compressed and ready to force the valve member 260 to a closed position. The extension springs 302 pull the pin 286 upwards and maintain the pin 286 in contact with the fixed cylindrical sleeve 254.

Figure 7:
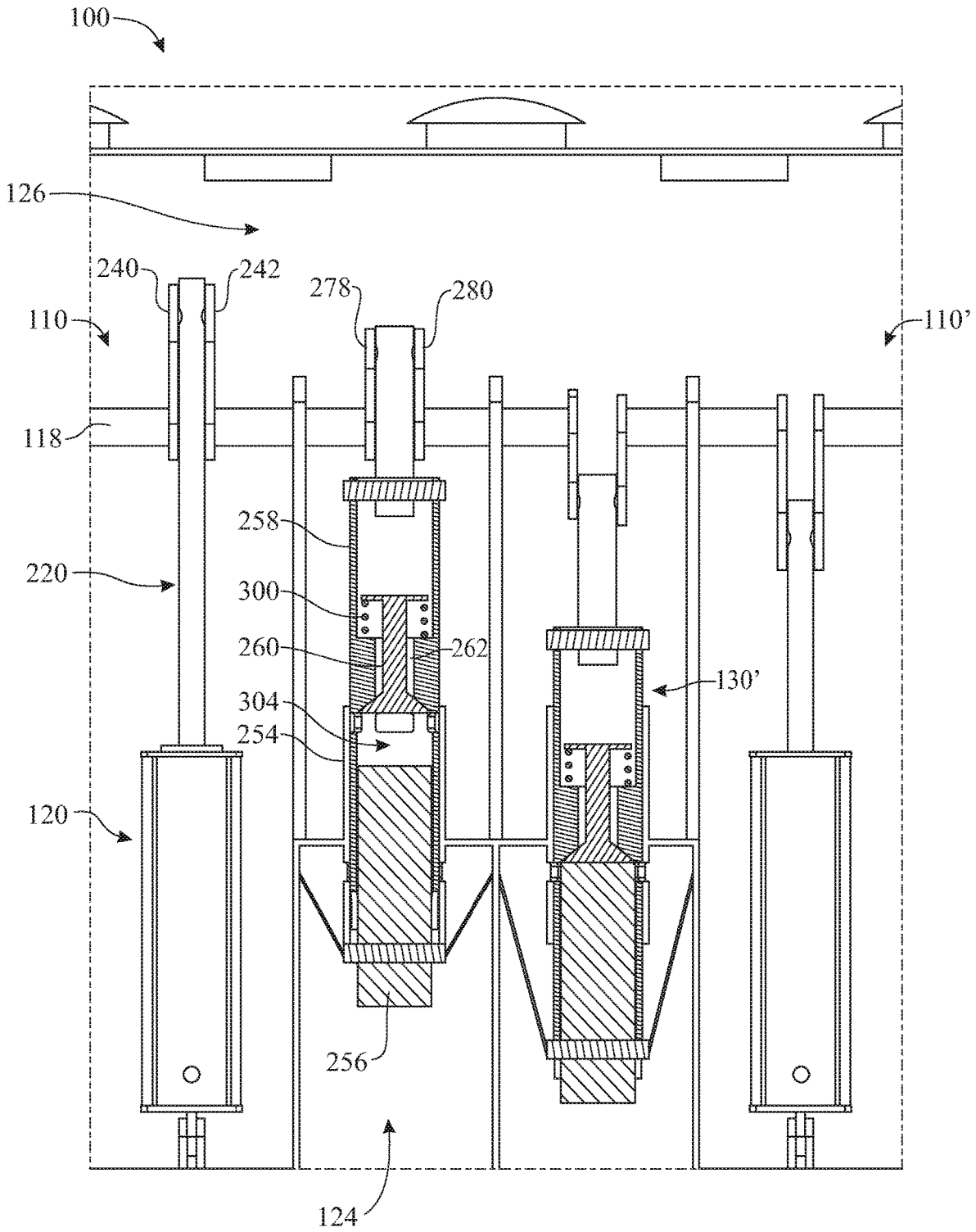
FIG. 7 presents an enlarged front elevation view, partially shown in cross-section, of the driving and pumping systems in a third position of a cycle of operation, with a valve member of the pump assembly closing to seal the low pressure fluid within the pump assembly.

The expanding piston assembly 120 and rising fluid pumping system 114 eventually reach the position of FIG. 7, in which the first crankshaft brackets 240, 242 and the second crankshaft brackets 278, 280 are at their topmost position. Until now, the common crankshaft 118 has been driven mainly by the piston assembly 120, as described heretofore. In reaching the situation of FIG. 7, the sensor 180 detects that the plunger 220 is in the topmost position and thus ready to start compressing downward. Responsively, the sensor 180 signals the receiver 210 (FIG. 3) in the first drive valve 190 to close the first shutter 206 and open the second shutter 208. This closes off the incoming flow of high pressure fluid from the high pressure fluid tank 124 and supply tube 186 into the lower chamber 222 of the piston assembly 120, and enables outgoing fluid communication from the lower chamber 222 of the piston assembly 120 to the cavity 214 in the second drive valve 192. In addition, as the internal space 304 of the pump assembly 130 is filled with low pressure fluid in the situation of FIG. 7, and there is no longer a vacuum within the internal space 304; thus, the biasing spring 300 has been able to move the valve member 260 back into a sealed condition onto the bottom tapered opening 263*a* of the intermediate channel 262, isolating the internal space 304 and confining the low pressure fluid within the internal space 304.

Figure 11:
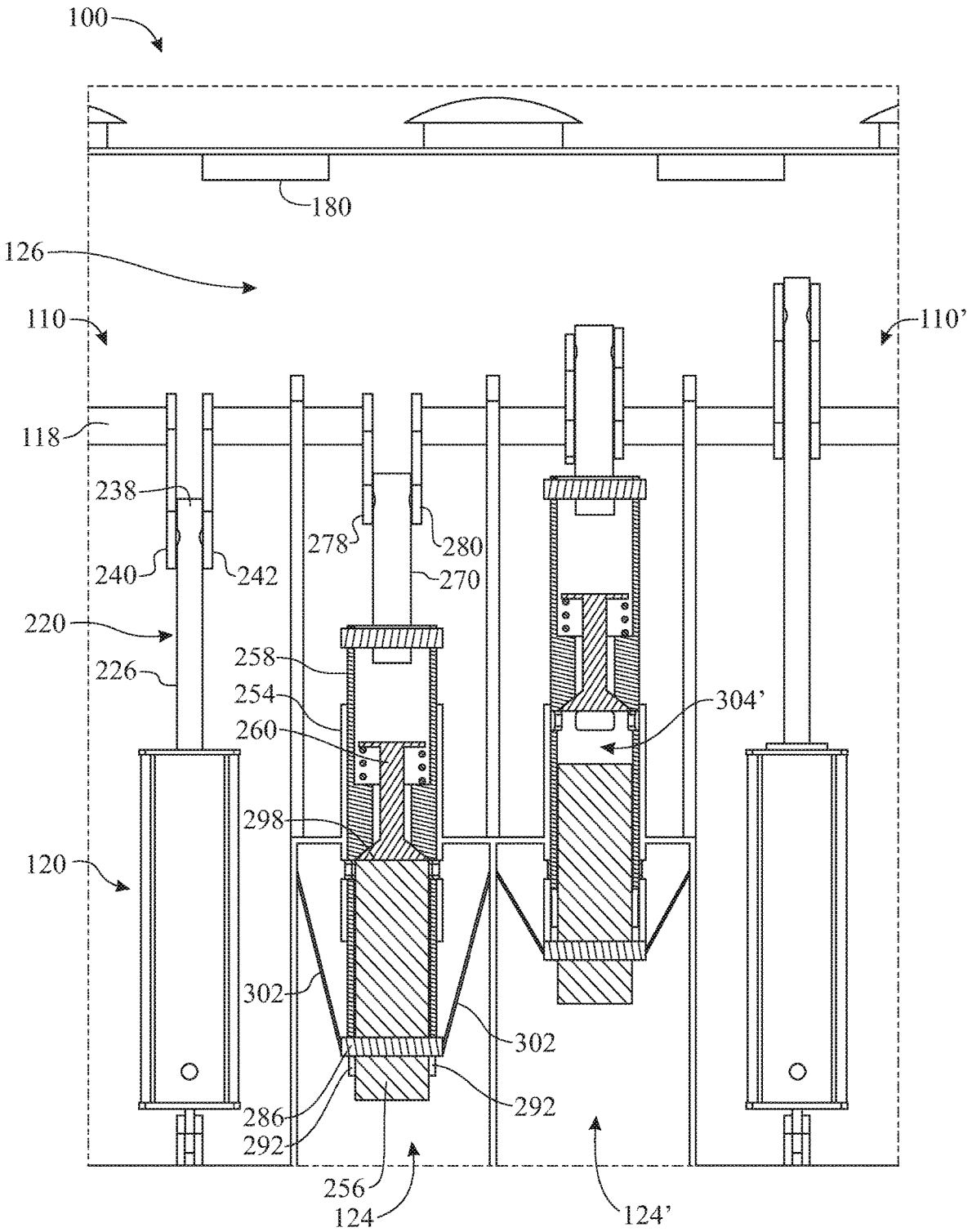
FIG. 11 presents an enlarged front elevation view, partially shown in cross-section, of the driving and pumping systems in a seventh position of a cycle of operation, with extension springs of the pump assembly sealing a solid sleeve of the pump assembly against the valve member of the pump assembly.

From the situation of FIG. 7, the common crankshaft 118 continues to rotate driven by the pump assembly 130' of the hydraulic sub-system 110' (which is in a position matching the position of pump assembly 130 in FIG. 11); in addition, the common crankshaft 118 is also driven by inertia and, optionally, can also be driven by a counterweight and/or another external actuator as known in the art. Continued rotation of the common crankshaft 118 causes the plunger 220 to begin to compress. With reference to FIG. 3, as the plunger 220 compresses downward within the piston sleeve 200, and the piston head 224 pushes high pressure fluid out of the lower chamber 222, through the open second shutter 208 into the cavity 214 of the second drive valve 192; it must be noted that the term "high pressure", when referring to that of the fluid pushed out of the lower chamber 222 by the piston head 224, is not to be understood as being as high as the pressure in the high pressure tank 124; instead, the term "high pressure" in regard to the fluid being pushed out of the low chamber 222 is being used for simplicity, in order to reflect that the pushing by the piston head 224 increases the pressure of the low pressure fluid housed within the lower chamber 222 in addition to expelling the fluid from the low pressure chamber 222. The high pressure fluid forces the first one-way valve 216 open (while the second one-way valve 218 remains closed) to allow the high pressure fluid to pass into the return tube 188. The returning high pressure fluid is directed through the return tube 188 to flow into the auxiliary tanks 128 (FIGS. 1 and 2). From the auxiliary tanks 128, the high pressure fluid flows into the dissipation chamber 194 through the orifice 166. As the high pressure fluid flows through the orifice 166, the fluid passes up between the opposed and inwardly extending baffle plates 162 and 164 of the dissipation chamber 194, the fluid being slowed down by contact with the baffle plates 162 and 164. This reduces the speed of the returning fluid and allows it to equalize to the lower pressure of the fluid within the low pressure fluid tank 126 as the fluid is directed back to the low pressure fluid tank 126. Alternative embodiments are contemplated, however, in which the high pressure fluid pushed out of the lower chamber 222 by the compressing piston head 224 could be transferred to an entirely separate system; for instance, the expelled fluid could be used to hydraulically power a separate, smaller hydraulically-powered system.

Figure 8:
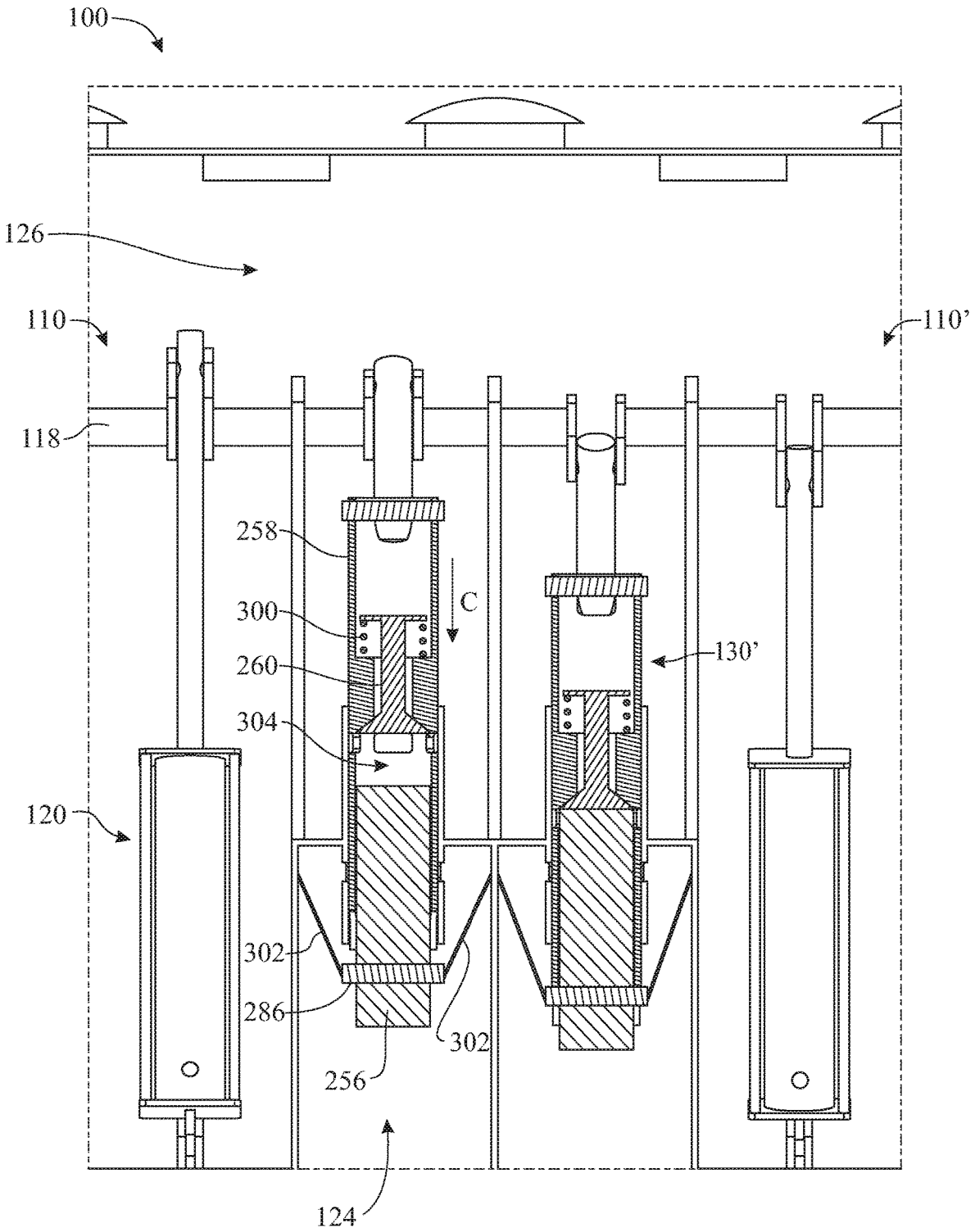
FIG. 8 presents an enlarged front elevation view, partially shown in cross-section, of the driving and pumping systems in a fourth position of a cycle of operation, with the pump assembly driving downward into a first high pressure fluid tank to increase the fluid pressure therein.

Referring now to FIG. 8, as the common crankshaft 118 continues to rotate as driven by the pump assembly 130', the movable inner sleeve 258 of the fluid pumping system 114 is driven downward in the direction of arrow "C". The biasing spring 300 and the fluid isolated within the internal space 304 maintain the valve member 260 in the closed position. As the movable inner sleeve 258 moves downward, the valve member 260 pushes downward on the low pressure fluid confined in the inner space 304, increasing the pressure of the confined fluid; eventually, the confined fluid reaches a maximum pressure and does not compress any further; in consequence, the downward movement of the movable inner sleeve 258 and valve member 260 causes the fluid within the internal space 304 to push the solid cylinder 256 downward. In consequence, the movable inner cylinder 258, the valve member 260, the biasing spring 300, the (high pressure) fluid within the internal space 304, the solid cylinder 256 and the pin 286 move downward as a block. In moving downward as a block, the fluid pumping system 114 moves further into the high pressure fluid tank 124 thereby compressing and increasing the pressure of the fluid within the high pressure fluid tank 124. Turning now to FIG. 2, increased pressure in the high pressure fluid tank 124 causes high pressure fluid to exit the high pressure fluid tank 124 through the one-way valve 176 and forces the fluid through the inlet tube 172 to the external hydraulically-powered device 400 to operate that device. As the fluid passes through the device 400 it exits out the outlet tube 174 and is forced into the high pressure fluid tank 124' to contribute to increasing the pressure in the high pressure fluid tank 124'. In addition, with reference again to FIG. 8, the downward moving of the pin 286 pulls the extension springs 302. In consequence, the extension springs 302 begin to be put into tension and to exert an upward force on the pin 286 and thus on the solid cylinder 256.

Figure 9:
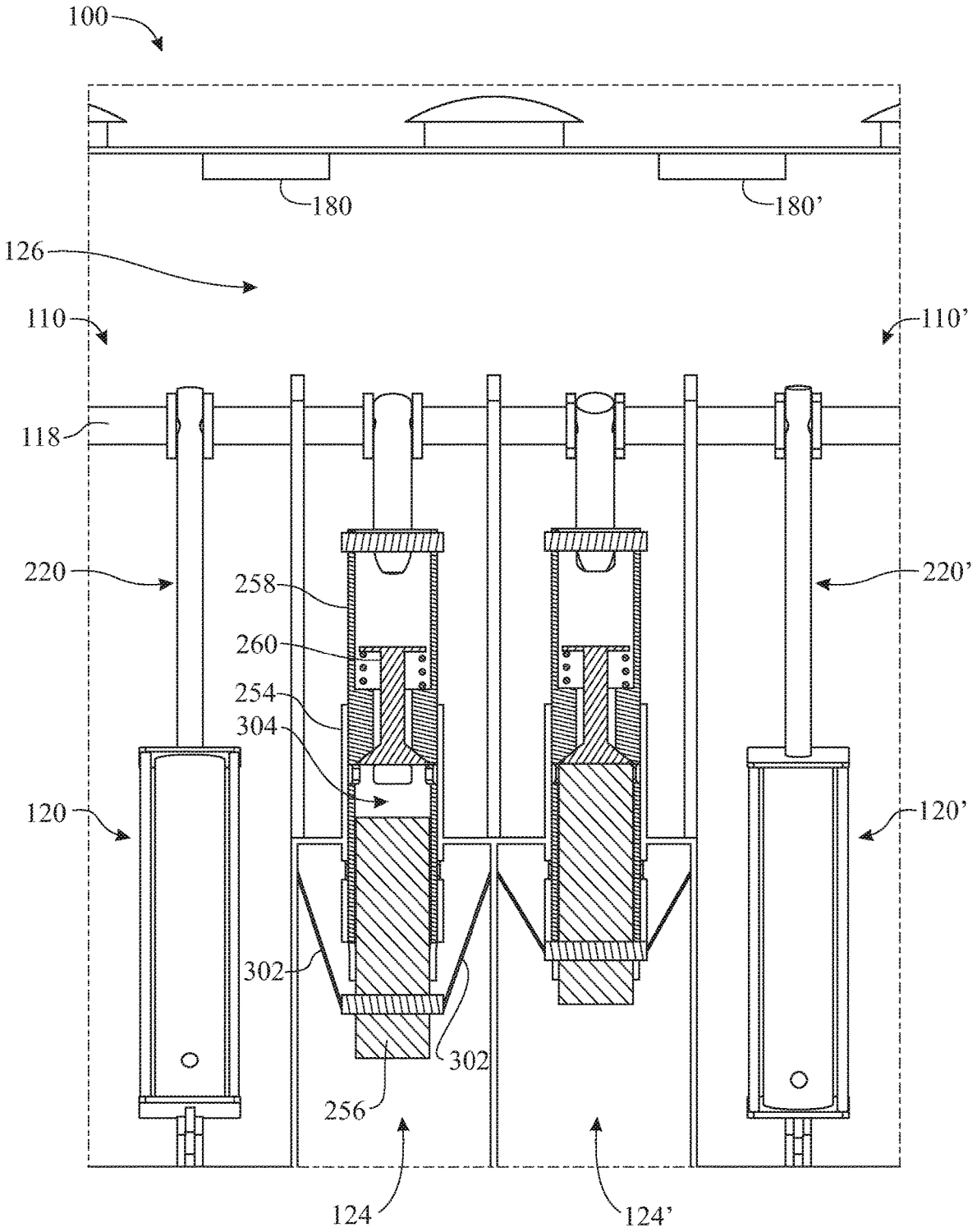
FIG. 9 presents an enlarged front elevation view, partially shown in cross-section, of the driving and pumping systems in a fifth position of a cycle of operation.

Referring to FIG. 9, high pressure fluid continues to be forced out of the lower chamber 222 of the piston sleeve 200 by the piston head 224 (FIG. 3). The combined movable inner sleeve 258, fluid within internal space 304, and solid cylinder 256 continue to move downward as a block and high pressure fluid continues to be provided to the external hydraulically-powered device 400. The mirror image hydraulic system 110' operates 180° out of phase with the hydraulic system 100 such that the plunger 220' of the piston assembly 120' (which is now in the same situation as piston assembly 120 was in FIG. 5) starts driving the common crankshaft 118 as the piston assembly 120' fills with high pressure fluid in response to signals sent by the sensor 180' to the first drive valve 190' (FIG. 2).

Figure 10:
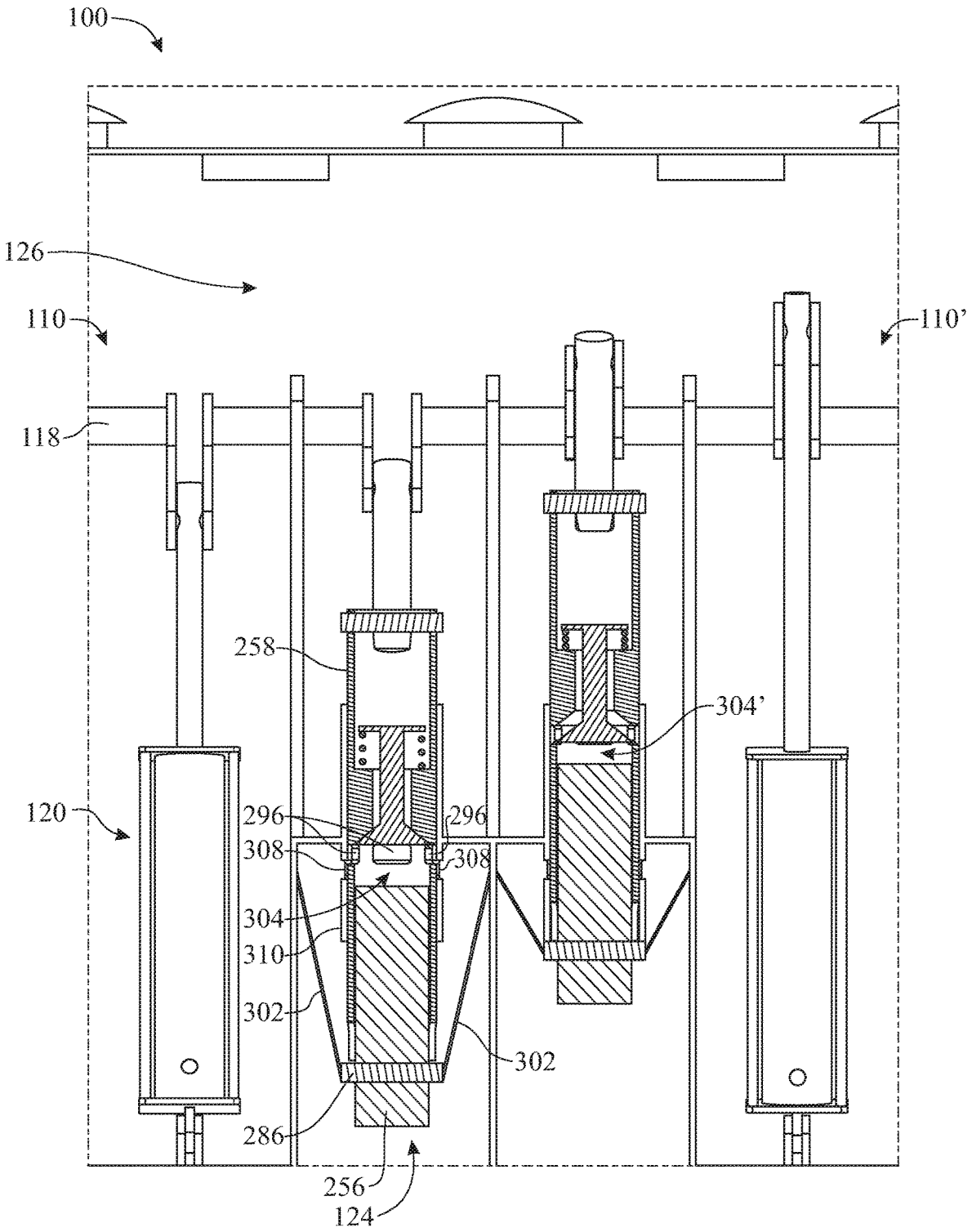
FIG. 10 presents an enlarged front elevation view, partially shown in cross-section, of the driving and pumping systems in a sixth position of a cycle of operation, with slots in a movable sleeve of the pump assembly aligned with windows in a fixed sleeve of the pump assembly to release the low pressure fluid from inside the pump assembly.

Turning now to FIG. 10, as the movable inner sleeve 258 of the hydraulic sub-system 110 continues moving downward, the windows 296 in the movable inner sleeve 258 start to align with fixed windows 308 formed through a lower portion 310 of the fixed cylindrical sleeve 254 (wherein the lower portion 310 and fixed windows 308 arranged inside the high pressure tank 124). Once said alignment begins, the internal space 304 is no longer isolated. Thus, continued downward movement of the movable inner sleeve 258 and thus of the valve member 260 forces the high pressure fluid contained within the internal space 304 out through the now aligned windows 296 and fixed windows 308; because the fluid within the internal space 304 is at a high pressure, it can pass through the aligned windows 296, 308 and penetrate the high pressure fluid tank 124. As the fluid is expelled into the high pressure fluid tank 124, the high pressure exerted by fluid in the high pressure fluid tank 124 on the bottom end of the solid cylinder 256 starts moving the pin 286 and solid cylinder 256 rearward (i.e. upward), towards the valve member 260, thus reducing the internal space 304 and helping expel the fluid therefrom. The fluid being injected into the high pressure fluid tank 124 further contributes to maintain the pressure increase within the high pressure fluid tank 124 and power the external hydraulically-powered device 400.

Figure 13:
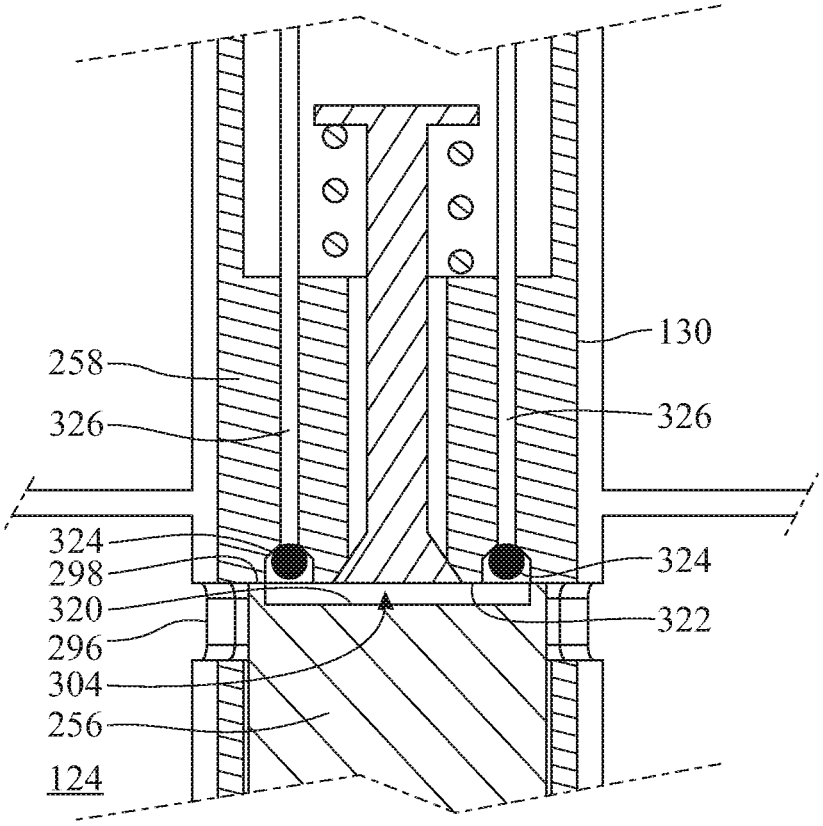
FIG. 13 presents an enlarged front elevation view of an alternative embodiment of the invention, in a position similar to that of FIG. 11.

Referring to FIGS. 3 and 11, as the plunger 220 and, in particular, the piston head 224 reaches its lowest position within the piston sleeve 200, the fluid pressure from the lower chamber 222 of the piston sleeve 200 and thus the pressure in the cavity 214 of the second drive valve 192 decrease. In consequence, with reference to FIG. 3, the first one-way valve 216 closes and fluid is no longer directed towards the low pressure tank 126 via the return tube 188. In addition, as shown in FIG. 11, the high-pressure fluid in the high pressure fluid tank 124 has pushed the solid cylinder 256 back up so that the upper surface 298 of the solid cylinder 256 again rests against the valve member 260 eliminating the internal space 304 therebetween and thus completely expelling the fluid from the internal space 304. In an alternative embodiment of the invention, shown in FIG. 13, the top end or upper surface 298 of the solid cylinder 256 may be provided with a shallow recess 320 (e.g. 1/16" or 1/32" deep) which guarantees that a small amount of fluid remains between the top end of the solid cylinder 256 and an inner face 322 of the movable inner sleeve 258, to ensure that the high-pressure fluid in the high pressure fluid tank 124 exerts a resulting upward force on the solid cylinder 256 that is able to push the solid cylinder 256 all the way up to its topmost position against the inner face 322 and therefore expel as much fluid as possible from in between the solid cylinder 256 and the movable inner sleeve 258. As the windows 296 of the movable inner sleeve 258 become blocked by the ascending solid cylinder 256, one or more normally-closed valves 324 (schematically depicted herein as spheres) may be operated to an open position in order to allow some fluid from the internal space 304 to exit the internal space 304 through one or more respective conduits 326; for instance and without limitation, the valves 324 may be operated by respective cams attached to the crankshaft 118, as known in the art. These features may contribute to maximize the ascending pushing force exerted by the solid cylinder 256 on the movable inner sleeve 258 (due to the high pressure fluid in the high pressure fluid tank 124 pushing the solid cylinder 256 upward) in order to drive the pump assembly 130 upward and drive the crankshaft 118, and thus increase the efficiency of the hydraulic system 100.

Turning back to the first embodiment and, particularly, to the situation of FIG. 11, the pin 286 has moved upward along the slots 292 of the movable inner sleeve 258 and is now arranged substantially at the inner end of the slots 292. Thus, the extension springs 302, which are still significantly extended, are exerting an upward force on the pin 286, and thus on the solid cylinder 256; in addition, high fluid pressure within the high pressure tank 124 is pushing the solid cylinder 256 upward. Upward pushing of the solid cylinder 256 is transferred to the valve member 260, which in turn pushes the movable inner sleeve 258 and the articulation shaft 270 upward. In consequence, the pump assembly 130 begins to drive the common crankshaft 118. In consequence, the brackets 240, 242 pull on the top end 238 of the piston rod 226 of the plunger 220, and cause the plunger 220 to rise relative to the piston sleeve 200. As the plunger 220 rises, the volume of the lower chamber 222 increases and thus a depression is formed in the lower chamber 222. The depression causes fluid to be suctioned into the lower chamber 222 from the drive tube 198, cavity 212, connection tube 196 and cavity 194 (through the open second shutter 208). The suctioning of fluid from the cavity 194 of the second drive valve 192 causes the second one-way valve 218 to open (while the first one-way valve 216 remains closed), allowing low pressure fluid in the second return tube 204 (from the low pressure fluid tank 126) to be sucked through the second drive valve 192, the second shutter 208 and the first drive valve 190, and to enter the lower chamber 222 of the piston cylinder 200. The low pressure fluid entering the lower chamber 222 pushes the piston head 226 and piston rod 226 upward.

In a next situation shown in FIG. 12, the low pressure fluid passing through the second shutter 208 and the first drive valve 190 continues to add to the upward motion of the plunger 220 within the piston sleeve 200 to contribute to return the system to the status of FIG. 5. In addition, the extension springs 302 are pulling the fluid pumping system 114 upward as a block by pulling on the pin 286; because the pin 286 is at the inner end of the slots 292, the pin 286 pushes the movable inner sleeve 258 upward while the solid cylinder 256 pushes the valve member 260 upward, all of them therefore moving upward as a block, continuing to drive the common crankshaft 118 and contributing to return the system to the status of FIG. 5. Upon reaching the situation of FIG. 5, the cycle will start again, i.e. the sensor 180 will close the second shutter 208 and open the first shutter 206 to again allow high pressure fluid to pass through the first drive valve 190 and strongly force the plunger 220 upward through the piston cylinder 200 to continue the cycle.

As discussed at each stage of movement of the drive system 116 (including the piston assembly 120 and the valving assembly 122) and the fluid pumping system 114 (including the pump assembly 130), the corresponding mirror image components of the hydraulic system 100, such as the piston assembly 120', the valving assembly 122' and the pump assembly 130', are operating 180° out of phase such that their motions complement and reinforce the movement of the common crankshaft 118 and function to force high pressure fluid through the inlet tube 172', the one-way valve 176' and through the external hydraulically powered device 400' to power said device. The fluid then reenters the high pressure fluid tank 124 through the outlet tube 174'. In this manner, the disclosed hydraulic system 100 functions to push high pressure fluid from one high pressure fluid tank 124, 124' to the other 124', 124 and back and forth through hydraulically powered devices 400, 400' in a "see-saw-like" motion.

Therefore, as explained heretofore, the hydraulic system 100 disclosed herein drives itself to maintain a continuous and cyclical operation by which the hydraulic system 100 is capable of providing hydraulic pressure to external hydraulically-powered systems. Operation of the hydraulic system 100 can be initiated by any applicable driving mechanism; for instance and without limitation, the hydraulic system 100 can include an electrical motor initially coupled to the common crankshaft 118 to cause the common crankshaft 118 to start rotating and drive it to rotate at the working frequency (desired frequency of operation of the hydraulic system 100). Once the working frequency is reached, the piston assembly 120 (FIGS. 5-7), pump assembly 130' (FIGS. 7-9), piston assembly 120' (FIGS. 9-11) and pump assembly 130 (FIGS. 11, 12 and 5) take turns driving the common crankshaft 118, as described heretofore, driven mainly by the high pressure fluid in the high pressure fluid tank 124. Once the hydraulic system 100 reaches the working frequency, the hydraulic system 100 can continue operating without the initial, external driving mechanism (e.g. the motor) being required to drive the common crankshaft 118.

In this manner, the disclosed hydraulic system functions to convert fluid pressure energy into kinetic energy and convert the kinetic energy back into fluid pressure energy, and in this process, do a work (for instance, provide hydraulic power to external hydraulic systems).

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A hydraulic system for hydraulically powering one or more external devices, comprising:

at least one pump assembly, wherein each pump assembly is formed along a longitudinal direction extending from a proximal end to a distal end of the pump assembly, each pump assembly including:

an outer sleeve having at least one window formed through a sidewall of the outer sleeve, an inner sleeve, longitudinally movable inside the outer sleeve, the inner sleeve including a first inner cavity and a second inner cavity arranged within the inner sleeve, wherein the second inner cavity is longitudinally spaced apart and positioned distally from the first inner cavity, the inner sleeve further comprising at least one window formed through a sidewall of the inner sleeve and facing the second inner cavity, a valve member, longitudinally movable inside the inner sleeve and configured to reversibly move between a closed position, blocking fluid flow between the first and second inner cavities of the inner sleeve, and an open position, allowing fluid flow between the first and second inner cavities of the inner sleeve, and an end body, positioned distally from the valve member and longitudinally movable within the second inner cavity of the inner sleeve; wherein the pump assembly can adopt:

a driving configuration in which the valve member is in the closed position and the end body pushes the inner sleeve towards the proximal end of the pump assembly, and a pumping configuration in which the inner sleeve and end body move distally relative to the outer sleeve and the end body provides a pushing end of the pump assembly for pushing a fluid.

2. The hydraulic system of claim 1, further comprising a high pressure fluid tank, wherein, in said driving configuration of the pump assembly, the end body is arranged within the high pressure fluid tank and is pushed toward the inner sleeve by pressure from fluid contained within the high pressure fluid tank.

3. The hydraulic system of claim 2, wherein the outer sleeve is non-movable relative to the high pressure fluid tank.

4. The hydraulic system of claim 2, wherein the high pressure fluid tank is in fluid communication with a hydraulically-powered system for feeding fluid from the high pressure fluid tank to the hydraulically-powered system to power the hydraulically-powered system.

5. The hydraulic system of claim 1, wherein the pump assembly can further adopt a fluid-intaking configuration in which the end body is stopped from moving longitudinally and proximally by the outer sleeve and the inner sleeve is moving proximally relative to the end body, an enclosed internal space being formed between the inner sleeve and the end body and a depression being formed within said internal space, said depression moving the valve member to the open position allowing the passage of a specific amount of fluid from the first inner cavity of the inner sleeve to the internal space.

6. The hydraulic system of claim 5, further comprising a low pressure fluid tank, wherein a proximal end of the inner sleeve is arranged within said low pressure fluid tank and further wherein, in said fluid-intaking configuration of the pump assembly, the first inner cavity is in fluid communication with the low pressure fluid tank for absorbing fluid therefrom.

7. The hydraulic system of claim 6, wherein the outer sleeve is non-movable relative to the low pressure fluid tank.

8. The hydraulic system of claim 5, wherein the pump assembly can further adopt a fluid-transporting configuration in which said valve member is in the closed position and said inner sleeve, valve member, end body and specific amount of fluid move jointly and distally relative to the outer sleeve and carry the specific amount of fluid towards the at least one window formed on the sidewall of the outer sleeve.

9. The hydraulic system of claim 8, wherein the pump assembly can further adopt a fluid-expelling configuration in which said internal space and said at least one window formed on the sidewall of the inner sleeve are at least partially aligned with said at least one window formed on the sidewall of the outer sleeve, and further in which the end body is moving proximally relative to the inner sleeve and pushing the specific amount of fluid from the internal space to flow outward of the pump assembly through the at least one window formed on the sidewall of the inner sleeve and the at least one window formed on the sidewall of the outer sleeve.

10. The hydraulic system of claim 5, wherein a proximal end of the end body comprises a recess facing at least one closure valve configured to selectively allow or prevent fluid flow from the internal space towards the first inner cavity of the inner sleeve, and further wherein, in said driving configuration of the pump assembly, the at least one closure valve is open allowing fluid to flow from the internal space towards the first inner cavity.

11. The hydraulic system of claim 1, further comprising a crankshaft arranged proximally from the at least one pump assembly, wherein the pump assembly is pivotably and eccentrically attached to the crankshaft, and further wherein, in said driving configuration of the pump assembly, the pump assembly drives the crankshaft to rotate.

12. The hydraulic system of claim 11, wherein the pump assembly further includes an articulation shaft pivotably attached to the inner sleeve and pivotably and eccentrically attached to the crankshaft.

13. The hydraulic system of claim 11, further comprising two high pressure fluid tanks, wherein said at least one pump assembly comprises two pump assemblies attached to opposite sides of the crankshaft and operating in a 180-degree offset configuration, wherein the end body of each pump assembly is arranged within a respective one of the two high pressure fluid tanks, and the end bodies of the pump assemblies are alternately pushed toward the corresponding inner sleeve by pressure from fluid contained within the respective high pressure fluid tank.

14. The hydraulic system of claim 11, further comprising at least one piston assembly, wherein each piston assembly is associated to a respective pump assembly of said at least one pump assembly and is pivotably connected to the crankshaft and configured to expand and compress a chamber of the piston assembly in synchronization with rotation of the crankshaft, wherein the chamber of said piston assembly is in fluid communication with a valving system.

15. The hydraulic system of claim 14, wherein the valving system is configured to selectively establish fluid communication from the chamber of the piston assembly towards a low pressure fluid tank external to the piston assembly when the piston is assembly is compressing.

16. The hydraulic system of claim 14, wherein the valving system is configured to selectively establish fluid communication from a low pressure fluid tank external to the piston assembly to the chamber of the piston assembly when the piston assembly is expanding by the crankshaft rotating responsively to the pump assembly being in the driving configuration and driving the crankshaft.

17. The hydraulic system of claim 14, wherein the valving system is configured to selectively establish fluid communication from a high pressure fluid tank external to the piston assembly to the chamber of the piston assembly to force the piston assembly to expand and drive the crankshaft.

18. A hydraulic system for hydraulically powering one or more external devices, comprising:

a crankshaft; and two pump assemblies, wherein each pump assembly is formed along a longitudinal direction extending from a proximal end to a distal end of the pump assembly, and wherein the pump assemblies are pivotably and eccentrically attached to opposite sides of the crankshaft and operating in a 180-degree offset configuration, each pump assembly including:

an outer sleeve having at least one window formed through a sidewall of the outer sleeve, an inner sleeve, longitudinally movable inside the outer sleeve, the inner sleeve including a first inner cavity and a second inner cavity arranged within the inner sleeve, wherein the second inner cavity is longitudinally spaced apart and positioned distally from the first inner cavity, the inner sleeve further comprising at least one window formed through a sidewall of the inner sleeve and facing the second inner cavity, a valve member, longitudinally movable inside the inner sleeve and configured to reversibly move between a closed position, blocking fluid flow between the first and second inner cavities of the inner sleeve, and an open position, allowing fluid flow between the first and second inner cavities of the inner sleeve, and an end body, positioned distally from the valve member and longitudinally movable within the second inner cavity of the inner sleeve;

each pump assembly can adopt:

a driving configuration in which the valve member is in the closed position and the end body pushes the inner sleeve towards the proximal end of the pump assembly, and further in which the pump assembly drives the crankshaft to rotate, and a pumping configuration in which the inner sleeve and end body move distally relative to the outer sleeve and the end body provides a pushing end of the pump assembly for pushing a fluid.

19. A hydraulic system for hydraulically powering one or more external devices, comprising:

at least one pump assembly, wherein each pump assembly is formed along a longitudinal direction extending from a proximal end to a distal end of the pump assembly, each pump assembly including:

an outer sleeve having at least one window formed through a sidewall of the outer sleeve, an inner sleeve, longitudinally movable inside the outer sleeve, the inner sleeve including a first inner cavity and a second inner cavity arranged within the inner sleeve, wherein the second inner cavity is longitudinally spaced apart and positioned distally from the first inner cavity, the inner sleeve further comprising at least one window formed through a sidewall of the inner sleeve and facing the second inner cavity, a valve member, longitudinally movable inside the inner sleeve and configured to reversibly move between a closed position, blocking fluid flow between the first and second inner cavities of the inner sleeve, and an open position, allowing fluid flow between the first and second inner cavities of the inner sleeve, and an end body, positioned distally from the valve member and longitudinally movable within the second inner cavity of the inner sleeve; and a high pressure fluid tank; wherein the pump assembly can adopt a driving configuration in which the valve member is in the closed position and the end body pushes the inner sleeve towards the proximal end of the pump assembly, and further in which the end body is arranged within the high pressure fluid tank and is pushed toward the inner sleeve by pressure from fluid contained within the high pressure fluid tank.

20. The hydraulic system of claim 19, wherein the outer sleeve is non-movable relative to the high pressure fluid tank.

21. The hydraulic system of claim 19, wherein the high pressure fluid tank is in fluid communication with a hydraulically-powered system for feeding fluid from the high pressure fluid tank to the hydraulically-powered system to power the hydraulically-powered system.

22. A hydraulic system for hydraulically powering one or more external devices, comprising:

at least one pump assembly, wherein each pump assembly is formed along a longitudinal direction extending from a proximal end to a distal end of the pump assembly, each pump assembly including:

an outer sleeve having at least one window formed through a sidewall of the outer sleeve, an inner sleeve, longitudinally movable inside the outer sleeve, the inner sleeve including a first inner cavity and a second inner cavity arranged within the inner sleeve, wherein the second inner cavity is longitudinally spaced apart and positioned distally from the first inner cavity, the inner sleeve further comprising at least one window formed through a sidewall of the inner sleeve and facing the second inner cavity, a valve member, longitudinally movable inside the inner sleeve and configured to reversibly move between a closed position, blocking fluid flow between the first and second inner cavities of the inner sleeve, and an open position, allowing fluid flow between the first and second inner cavities of the inner sleeve, and an end body, positioned distally from the valve member and longitudinally movable within the second inner cavity of the inner sleeve; wherein the pump assembly can adopt:

a driving configuration in which the valve member is in the closed position and the end body pushes the inner sleeve towards the proximal end of the pump assembly;

a fluid-intaking configuration in which the end body is stopped from moving longitudinally and proximally by the outer sleeve and the inner sleeve is moving proximally relative to the end body, an enclosed internal space being formed between the inner sleeve and the end body and a depression being formed within said internal space, said depression moving the valve member to the open position allowing the passage of a specific amount of fluid from the first inner cavity of the inner sleeve to the internal space; and a fluid-transporting configuration in which said valve member is in the closed position and said inner sleeve, valve member, end body and specific amount of fluid move jointly and distally relative to the outer sleeve and carry the specific amount of fluid towards the at least one window formed on the sidewall of the outer sleeve.

23. The hydraulic system of claim 22, wherein the pump assembly can further adopt a fluid-expelling configuration in which said internal space and said at least one window formed on the sidewall of the inner sleeve are at least partially aligned with said at least one window formed on the sidewall of the outer sleeve, and further in which the end body is moving proximally relative to the inner sleeve and pushing the specific amount of fluid from the internal space to flow outward of the pump assembly through the at least one window formed on the sidewall of the inner sleeve and the at least one window formed on the sidewall of the outer sleeve.

24. A hydraulic system for hydraulically powering one or more external devices, comprising:

two pump assemblies, wherein each pump assembly is formed along a longitudinal direction extending from a proximal end to a distal end of the pump assembly, each pump assembly including:

an outer sleeve having at least one window formed through a sidewall of the outer sleeve, an inner sleeve, longitudinally movable inside the outer sleeve, the inner sleeve including a first inner cavity and a second inner cavity arranged within the inner sleeve, wherein the second inner cavity is longitudinally spaced apart and positioned distally from the first inner cavity, the inner sleeve further comprising at least one window formed through a sidewall of the inner sleeve and facing the second inner cavity, a valve member, longitudinally movable inside the inner sleeve and configured to reversibly move between a closed position, blocking fluid flow between the first and second inner cavities of the inner sleeve, and an open position, allowing fluid flow between the first and second inner cavities of the inner sleeve, and an end body, positioned distally from the valve member and longitudinally movable within the second inner cavity of the inner sleeve;

a crankshaft arranged proximally from the two pump assemblies, wherein the two pump assemblies are pivotably and eccentrically attached to opposite sides of the crankshaft and operate in a 180-degree offset configuration; and two high pressure fluid tanks, wherein the end body of each pump assembly is arranged within a respective one of the two high pressure fluid tanks, and the end bodies of the pump assemblies are alternately pushed toward the corresponding inner sleeve by pressure from fluid contained within the respective high pressure fluid tank; wherein each pump assembly can adopt a driving configuration in which the valve member is in the closed position and the end body pushes the inner sleeve towards the proximal end of the pump assembly, and further in which the pump assembly drives the crankshaft to rotate.

25. A hydraulic system for hydraulically powering one or more external devices, comprising:

at least one pump assembly, wherein each pump assembly is formed along a longitudinal direction extending from a proximal end to a distal end of the pump assembly, each pump assembly including:

an outer sleeve having at least one window formed through a sidewall of the outer sleeve, an inner sleeve, longitudinally movable inside the outer sleeve, the inner sleeve including a first inner cavity and a second inner cavity arranged within the inner sleeve, wherein the second inner cavity is longitudinally spaced apart and positioned distally from the first inner cavity, the inner sleeve further comprising at least one window formed through a sidewall of the inner sleeve and facing the second inner cavity, a valve member, longitudinally movable inside the inner sleeve and configured to reversibly move between a closed position, blocking fluid flow between the first and second inner cavities of the inner sleeve, and an open position, allowing fluid flow between the first and second inner cavities of the inner sleeve, and an end body, positioned distally from the valve member and longitudinally movable within the second inner cavity of the inner sleeve;

a crankshaft arranged proximally from the at least one pump assembly, wherein the pump assembly is pivotably and eccentrically attached to the crankshaft; and at least one piston assembly, wherein each piston assembly is associated to a respective pump assembly of said at least one pump assembly and is pivotably connected to the crankshaft and configured to expand and compress a chamber of the piston assembly in synchronization with rotation of the crankshaft, wherein the chamber of said piston assembly is in fluid communication with a valving system, wherein the valving system is configured to selectively establish fluid communication from the chamber of the piston assembly towards a low pressure fluid tank external to the piston assembly when the piston is assembly is compressing; wherein the pump assembly can adopt a driving configuration in which the valve member is in the closed position and the end body pushes the inner sleeve towards the proximal end of the pump assembly, and further in which the pump assembly drives the crankshaft to rotate.

26. A hydraulic system for hydraulically powering one or more external devices, comprising:

at least one pump assembly, wherein each pump assembly is formed along a longitudinal direction extending from a proximal end to a distal end of the pump assembly, each pump assembly including:

an outer sleeve having at least one window formed through a sidewall of the outer sleeve, an inner sleeve, longitudinally movable inside the outer sleeve, the inner sleeve including a first inner cavity and a second inner cavity arranged within the inner sleeve, wherein the second inner cavity is longitudinally spaced apart and positioned distally from the first inner cavity, the inner sleeve further comprising at least one window formed through a sidewall of the inner sleeve and facing the second inner cavity, a valve member, longitudinally movable inside the inner sleeve and configured to reversibly move between a closed position, blocking fluid flow between the first and second inner cavities of the inner sleeve, and an open position, allowing fluid flow between the first and second inner cavities of the inner sleeve, and an end body, positioned distally from the valve member and longitudinally movable within the second inner cavity of the inner sleeve;

a crankshaft arranged proximally from the at least one pump assembly, wherein the pump assembly is pivotably and eccentrically attached to the crankshaft; and at least one piston assembly, wherein each piston assembly is associated to a respective pump assembly of said at least one pump assembly and is pivotably connected to the crankshaft and configured to expand and compress a chamber of the piston assembly in synchronization with rotation of the crankshaft, wherein the chamber of said piston assembly is in fluid communication with a valving system, wherein the valving system is configured to selectively establish fluid communication from a low pressure fluid tank external to the piston assembly to the chamber of the piston assembly when the piston is assembly is expanding by the crankshaft rotating responsively to the pump assembly being in the driving configuration and driving the crankshaft; wherein the pump assembly can adopt a driving configuration in which the valve member is in the closed position and the end body pushes the inner sleeve towards the proximal end of the pump assembly, and further in which the pump assembly drives the crankshaft to rotate.

27. A hydraulic system for hydraulically powering one or more external devices, comprising:

at least one pump assembly, wherein each pump assembly is formed along a longitudinal direction extending from a proximal end to a distal end of the pump assembly, each pump assembly including:

an outer sleeve having at least one window formed through a sidewall of the outer sleeve, an inner sleeve, longitudinally movable inside the outer sleeve, the inner sleeve including a first inner cavity and a second inner cavity arranged within the inner sleeve, wherein the second inner cavity is longitudinally spaced apart and positioned distally from the first inner cavity, the inner sleeve further comprising at least one window formed through a sidewall of the inner sleeve and facing the second inner cavity, a valve member, longitudinally movable inside the inner sleeve and configured to reversibly move between a closed position, blocking fluid flow between the first and second inner cavities of the inner sleeve, and an open position, allowing fluid flow between the first and second inner cavities of the inner sleeve, and an end body, positioned distally from the valve member and longitudinally movable within the second inner cavity of the inner sleeve;

a crankshaft arranged proximally from the at least one pump assembly, wherein the pump assembly is pivotably and eccentrically attached to the crankshaft; and at least one piston assembly, wherein each piston assembly is associated to a respective pump assembly of said at least one pump assembly and is pivotably connected to the crankshaft and configured to expand and compress a chamber of the piston assembly in synchronization with rotation of the crankshaft, wherein the chamber of said piston assembly is in fluid communication with a valving system, wherein the valving system is configured to selectively establish fluid communication from a high pressure fluid tank external to the piston assembly to the chamber of the piston assembly to force the piston assembly to expand and drive the crankshaft; wherein the pump assembly can adopt a driving configuration in which the valve member is in the closed position and the end body pushes the inner sleeve towards the proximal end of the pump assembly, and further in which the pump assembly drives the crankshaft to rotate.

* * * * *